US012595929B2

(12) United States Patent
Ito et al.

(10) Patent No.: US 12,595,929 B2
(45) Date of Patent: Apr. 7, 2026

(54) AIR-CONDITIONING SYSTEM

(71) Applicant: Panasonic Intellectual Property Management Co., Ltd., Osaka (JP)

(72) Inventors: Keito Ito, Aichi (JP); Junya Kobayashi, Aichi (JP); Ryosuke Nagata, Saitama (JP); Masahiro Shigemori, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 102 days.

(21) Appl. No.: 18/683,223

(22) PCT Filed: May 16, 2022

(86) PCT No.: PCT/JP2022/020375
§ 371 (c)(1),
(2) Date: Feb. 12, 2024

(87) PCT Pub. No.: WO2023/026604
PCT Pub. Date: Mar. 2, 2023

(65) Prior Publication Data

US 2025/0137677 A1 May 1, 2025

(30) Foreign Application Priority Data

Aug. 27, 2021 (JP) ..... 2021-138482
Sep. 6, 2021 (JP) ..... 2021-144411

(51) Int. Cl.
*F24F 11/80* (2018.01)

(52) U.S. Cl.
CPC ..... *F24F 11/80* (2018.01)

(58) Field of Classification Search
CPC ..... F24F 11/80
See application file for complete search history.

(56) References Cited

U.S. PATENT DOCUMENTS

2016/0245569 A1* 8/2016 Unezaki ..... F24F 11/62
2016/0273794 A1* 9/2016 Kotani ..... F24F 11/84
(Continued)

FOREIGN PATENT DOCUMENTS

JP H07332739 A * 12/1995
JP 2000-104979 A 4/2000
(Continued)

OTHER PUBLICATIONS

Funada et al., Air Conditioning System and Air Conditioning System Controller, Jun. 6, 2019, WO2019107163A1, Whole document (Year: 2019).*
(Continued)

*Primary Examiner* — Larry L Furdge
(74) *Attorney, Agent, or Firm* — Renner, Otto, Boisselle & Sklar, LLP

(57) ABSTRACT

An air-conditioning system of the present disclosure includes air-conditioning unit (1) that supplies air-conditioned air to a plurality of air-conditioned spaces, unit body (2) that forms an outline of air-conditioning unit (1), air-conditioner (3) that performs temperature control of air taken into unit body (2), one or more air blowers (4) that blow, to an outside of unit body (2), air having been blown out from air-conditioner (3), and a controller that controls air-conditioner (3). Then, the controller (i) determines an air-conditioner set temperature such that an air-conditioner temperature difference, which is a temperature difference between an inlet temperature, which is a temperature of air suctioned by air-conditioner (3), and the air-conditioner set temperature set to air-conditioner (3), has a larger value than an air-conditioning stopping determination temperature difference, and (ii) causes air-conditioner (3) to perform an air-conditioning operation with the air-conditioner set temperature having been determined.

2 Claims, 19 Drawing Sheets

(56) References Cited

U.S. PATENT DOCUMENTS

| | | | | |
|---|---|---|---|---|
| 2016/0320113 | A1* | 11/2016 | Sekiya | F24F 11/84 |
| 2020/0292198 | A1 | 9/2020 | Funada et al. | |

FOREIGN PATENT DOCUMENTS

| | | | | |
|---|---|---|---|---|
| JP | 2002-257399 | A | | 9/2002 |
| JP | 2012-063117 | A | | 3/2012 |
| JP | 2012-127613 | A | | 7/2012 |
| JP | 2013249987 | A | * | 12/2013 |
| WO | 2015/068277 | A1 | | 5/2015 |
| WO | WO2019107163 | A1 | * | 6/2019 |

OTHER PUBLICATIONS

Takashi et al., Air Conditioner, Dec. 22, 1995, JPH07332739A, Whole Document (Year: 1995).*

Watabe, Air Conditioner, Dec. 12, 2013, JP2013249987A, Whole Document (Year: 2013).*

International Search Report for corresponding Application No. PCT/JP2022/020375, mailed Aug. 2, 2022.

* cited by examiner

DETERMINATION TABLE

| DETERMINATION | AIR-CONDITIONER TEMPERATURE DIFFERENCE SETTING VALUE |
|---|---|
| AIR-CONDITIONING REQUIREMENT AMOUNT < -0.5 | -0.5 |
| -0.5 ≤ AIR-CONDITIONING REQUIREMENT AMOUNT < 0 | 0.0 |
| 0 ≤ AIR-CONDITIONING REQUIREMENT AMOUNT < 1 | 0.5 |
| 1 ≤ AIR-CONDITIONING REQUIREMENT AMOUNT < 2 | 1.0 |
| 2 ≤ AIR-CONDITIONING REQUIREMENT AMOUNT | 2.0 |

(a)

(b)

DETERMINATION TABLE

| DETERMINATION | AIR-CONDITIONER TEMPERATURE DIFFERENCE SETTING VALUE |
|---|---|
| AIR-CONDITIONING REQUIREMENT AMOUNT < -0.5 | -0.5 |
| -0.5 ≤ AIR-CONDITIONING REQUIREMENT AMOUNT < 0 | 0.0 |
| 0 ≤ AIR-CONDITIONING REQUIREMENT AMOUNT < 1 | 0.5 |
| 1 ≤ AIR-CONDITIONING REQUIREMENT AMOUNT < 2 | 1.0 |
| 2 ≤ AIR-CONDITIONING REQUIREMENT AMOUNT | 2.0 |

AIR-CONDITIONING SYSTEM

TECHNICAL FIELD

The present disclosure relates to an air-conditioning system that enables air-conditioning of a plurality of rooms of a house with one air-conditioner.

BACKGROUND ART

Conventionally, as this type of air-conditioning system, an air-conditioning system in which an air-conditioner is installed in a dedicated space of a part of a house, the air-conditioner blows out temperature-controlled air (cold air or hot air) into the dedicated space, the temperature-controlled air is blown to each room via a duct by an air blower, and air-conditioning of each room is performed is known (see, for example, PTL 1).

The conventional air-conditioning system determines an air-conditioning requirement amount of the entire house using the room temperature of each room and a set temperature given to each room, and adjusts the set temperature given to the air-conditioner based on the determined air-conditioning requirement amount. The air-conditioner performs adjustment of blow out temperature and start/stop determination of air-conditioning operation based on the given set temperature and the temperature (inlet temperature) of the air suctioned by the air-conditioner.

CITATION LIST

Patent Literature

PTL 1: Unexamined Japanese Patent Publication No. 2002-257399

PTL 2: Unexamined Japanese Patent Publication No. 2000-104979

SUMMARY OF THE INVENTION

In such conventional air-conditioning system, the room temperature gets close to the set temperature of the room with slight air-conditioning operation in a season with a small outside air load such as a change of seasons, and therefore the output of the air-conditioning operation of the air-conditioner is suppressed by setting the set temperature of the air-conditioner to a value close to the room temperature. At this time, the inlet temperature of the air-conditioner does not necessarily coincide with the room temperature of each room of the house, and the air-conditioner is hidden and used in an air-conditioning unit, which is a space narrower than the room, and therefore, the inlet temperature may change depending on air-conditioning output of the air-conditioner. When the inlet temperature of the air-conditioner thus changes, the air-conditioner may perform start/stop operation of repeating air-conditioning operation and stop. In general, a state where an air-conditioner performs start/stop operation has a poor coefficient of performance (COP). That is, the conventional air-conditioning system has a problem that the energy saving performance deteriorates due to start/stop operation of the air-conditioner.

An object of the present disclosure is to provide an air-conditioning system that can suppress start/stop operation of an air-conditioner installed in an air-conditioning unit and improve energy saving performance.

An air-conditioning system according to the present disclosure includes: an air-conditioning unit that supplies air-conditioned air to a plurality of spaces; a unit body that forms an outline of the air-conditioning unit; an air-conditioner that performs temperature control of air taken into the unit body; at least one or more air blowers that blow, to an outside of the unit body, air having been blown out from the air-conditioner; and a controller that controls the air-conditioner. Then, the controller (i) determines an air-conditioner set temperature to cause an air-conditioner temperature difference, which is a temperature difference between an inlet temperature, which is a temperature of air suctioned by the air-conditioner, and the air-conditioner set temperature set to the air-conditioner, to have a larger value than an air-conditioning stopping determination temperature difference, and (ii) causes the air-conditioner to perform an air-conditioning operation with the air-conditioner set temperature having been determined, thereby achieving the intended object.

According to the present disclosure, it is possible to provide an air-conditioning system that can suppress start/stop operation of an air-conditioner installed in an air-conditioning unit and improve energy saving performance.

DESCRIPTION OF EMBODIMENT

Figure 1:
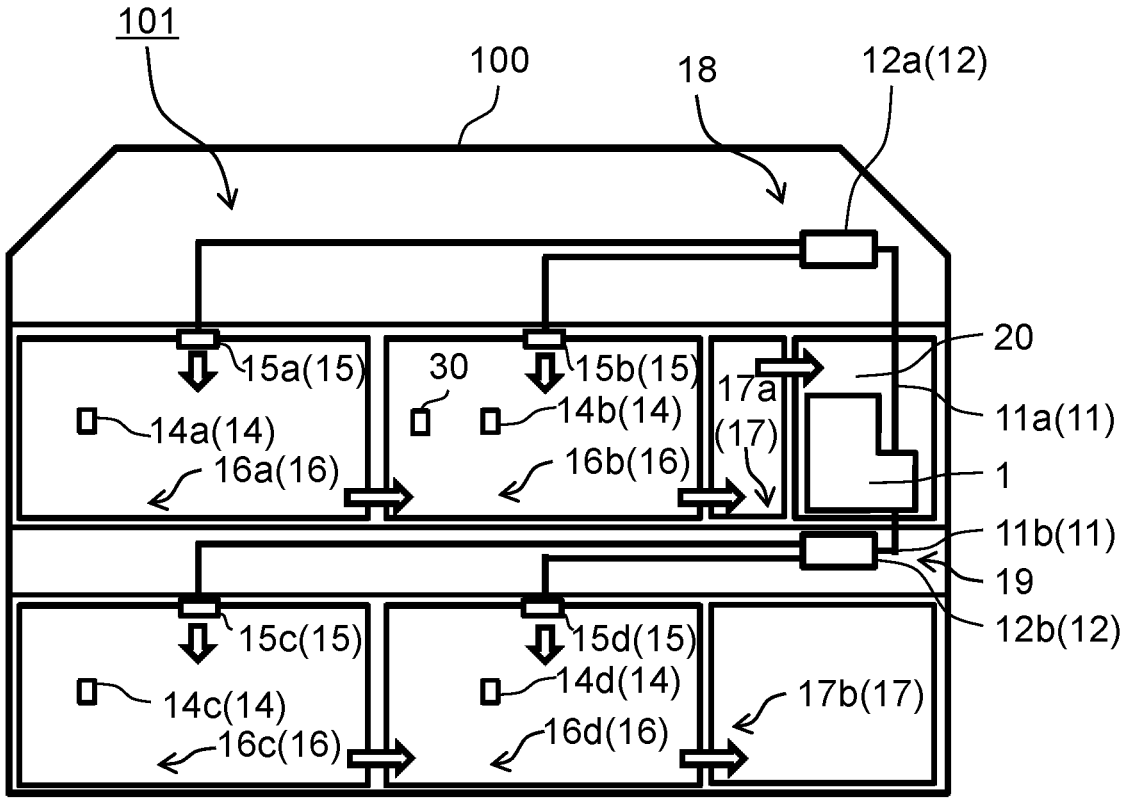
FIG. 1 is a configuration diagram of an air-conditioning system according to a first exemplary embodiment of the present disclosure.

An air-conditioning system according to the present disclosure includes: an air-conditioning unit that supplies air-conditioned air to a plurality of spaces; a unit body that forms an outline of the air-conditioning unit; an air-conditioner that performs temperature control of air taken into the unit body; one or more air blowers that blow, to an outside of unit body, air having been blown out from the air-conditioner; and a controller that controls the air-conditioner. Then, the controller (i) determines an air-conditioner set temperature such that an air-conditioner temperature difference, which is a temperature difference between an inlet temperature, which is a temperature of air suctioned by the air-conditioner, and the air-conditioner set temperature set to the air-conditioner, has a larger value than an air-conditioning stopping determination temperature difference, and (ii) causes the air-conditioner to perform an air-conditioning operation with the air-conditioner set temperature having been determined.

According to such configuration, since the air-conditioner behaves in a state where the air-conditioner temperature difference is larger than the air-conditioner set temperature, the COP is improved by the air-conditioner continuously operating without stopping, and the energy saving performance is improved.

In the air-conditioning system according to the present disclosure, the controller determines an air-conditioning requirement amount for each of the plurality of spaces based on a temperature difference between a temperature of the space and an indoor set temperature set for the space. Then, an air-conditioning operation of the air-conditioner is stopped when all of a first condition in which the air-conditioning requirement amount having been determined becomes less than or equal to a first reference temperature in all of the spaces, a second condition in which the air-conditioning requirement amount having been determined becomes less than or equal to a second reference temperature in at least one of the spaces, and a third condition in which an air-conditioning operating time of the air-conditioner becomes greater than or equal to a predetermined time in a state where a mean value of the air-conditioning requirement amounts having been determined becomes less than or equal to a third reference temperature are satisfied. Due to this, the air-conditioning operation of the air-conditioner is stopped only when all the spaces are sufficiently air-conditioned, when the air-conditioning becomes excessive in at least one space, and when a state where the output of the air-conditioning operation of the air-conditioner is minimum continues for a predetermined time. Therefore, the air-conditioning system is suppressed from excessively air-conditioning, and the air-conditioning operation is continued for a predetermined time from the start of the air-conditioning operation until the air-conditioning operation is stopped, and therefore the start/stop operation is suppressed, and the energy saving performance is improved.

In the air-conditioning system according to the present disclosure, the controller starts air-conditioning operation of the air-conditioner in a case where the air-conditioning requirement amount becomes larger than a fourth reference temperature in at least one of the spaces while the air-conditioner is stopping air-conditioning operation. Due to this, the air-conditioning system immediately starts the air-conditioning when the air-conditioning is insufficient in at least one of the spaces, and therefore can achieve energy saving without impairing comfort.

Hereinafter, exemplary embodiments of the present disclosure will be described with reference to the drawings.

First Exemplary Embodiment

First, an outline of air-conditioning system 101 according to the first exemplary embodiment of the present disclosure will be described with reference to FIG. 1. FIG. 1 is a configuration diagram of air-conditioning system 101 according to the first exemplary embodiment of the present disclosure.

Air-conditioning system 101 is a system for air-conditioning a plurality of spaces in a building with one air-conditioner. As illustrated in FIG. 1, air-conditioning system 101 is configured to include air-conditioning unit 1, a plurality of ducts 11 (ducts 11*a* and 11*b*), a plurality of branch chambers 12 (branch chambers 12*a* and 12*b*), indoor temperature sensor 14 (indoor temperature sensors 14*a* to 14*d*), air supply port 15 (air supply ports 15*a* to 15*d*), and controller 30. Then, air-conditioning system 101 performs air-conditioning of air-conditioned space 16 described later using the air having been temperature-controlled in air-conditioning unit 1.

Specifically, air-conditioning system 101 is installed in house 100, which is an example of building. House 100 includes, for example, air-conditioned spaces 16 (air-conditioned spaces 16*a* to 16*d*) corresponding to a room such as a living room, a bedroom, a dining room, a study room, and the like, common space 17 (common spaces 17*a* and 17*b*) corresponding to a corridor, a staircase, an open ceiling, and the like, and dedicated installation space 20 installed with air-conditioning unit 1 independently of air-conditioned space 16 and common space 17.

Air-conditioned space 16 is a space that becomes a target of air-conditioning in air-conditioning system 101. Air-conditioned space 16 includes air-conditioned spaces 16*a* and 16*b* positioned on the second floor of house 100 and air-conditioned spaces 16*c* and 16*d* positioned on the first floor of house 100. Air-conditioned spaces 16*a* to 16*d* are each supplied with temperature-controlled air from air-conditioning unit 1 described later.

Common space 17 is a space that is not a target of air-conditioning in air-conditioning system 101. Common space 17 includes common space 17*a* positioned on the second floor of house 100 and common space 17*b* positioned on the first floor of house 100. Common space 17*a* and common space 17*b* are continuous to each other via a stair not illustrated or the like. Similarly to air-conditioned space 16, common space 17 may be supplied with temperature-controlled air from air-conditioning unit 1 described later.

Dedicated installation space 20 is a space in which air-conditioning unit 1 is stored and installed. Dedicated installation space 20 is provided with a door (not illustrated), and the door faces common space 17, for example. This enables maintenance of air-conditioning unit 1 in dedicated installation space 20 to be easily performed.

Air-conditioning unit 1 is a unit that is installed in dedicated installation space 20, suctions air in house 100 into air-conditioning unit 1, and performs temperature control (cools or raises the temperature) and sends out the suctioned air. Details will be described later.

Duct 11 is a member that is provided in an in-wall space such as attic 18 or space 19 above the ceiling, and communicably connects air-conditioning unit 1 and air-conditioned space 16. Duct 11 has an inner wall surface or an outer wall surface, for example, subjected to heat insulation processing with glass wool or the like. Then, duct 11 is provided with branch chamber 12 on air-conditioning unit 1 side of duct 11, and provided with air supply port 15 on air-conditioned space 16 side of duct 11. More specifically, duct 11 includes duct 11*a* provided in attic 18 on the second floor and duct 11*b* provided in space 19 above the ceiling on the first floor. Then, duct 11*a* is provided with branch chamber 12*a* on air-conditioning unit 1 side of duct 11*a*, and provided with air supply ports 15*a* and 15*b* on air-conditioned space 16 side of duct 11*a*. Duct 11*b* is provided with branch chamber 12*b* on air-conditioning unit 1 side of duct 11*b*, and provided with air supply ports 15*c* and 15*d* on air-conditioned space 16 side of duct 11*b*.

Branch chamber 12 is a chamber that is installed on air-conditioning unit 1 side of duct 11 and branches, into a plurality of air-conditioned spaces 16, air (temperature-controlled air) sent out from air-conditioning unit 1. Branch chamber 12 includes branch chamber 12*a* provided in duct 11*a* and branch chamber 12*b* provided in duct 11*b*. Then, branch chamber 12*a* branches, into two systems of air-conditioned space 16*a* and air-conditioned space 16*b*, the air sent out from air-conditioning unit 1. Branch chamber 12*b* branches, into two systems of air-conditioned space 16*c* and air-conditioned space 16*d*, the air sent out from air-conditioning unit 1.

Air supply port 15 is an opening that is installed on a floor, a wall, or a ceiling of air-conditioned space 16, through which air (air-conditioned air) from air-conditioning unit 1 is blown out to air-conditioned space 16 via duct 11. More specifically, air supply port 15 includes air supply port 15*a* installed in air-conditioned space 16*a*, air supply port 15*b* installed in air-conditioned space 16*b*, air supply port 15*c* installed in air-conditioned space 16*c*, and air supply port 15*d* installed in air-conditioned space 16*d*. Then, air supply port 15*a* and air supply port 15*b* blow the air from air-conditioning unit 1 to air-conditioned space 16*a* and air-conditioned space 16*b*, respectively, via duct 11*a*. Air supply port 15*c* and air supply port 15*d* blow the air from air-conditioning unit 1 to air-conditioned space 16*c* and air-conditioned space 16*d*, respectively, via duct 11*b*.

Indoor temperature sensor 14 is installed in air-conditioned space 16 and detects the temperature (indoor temperature) of the air in air-conditioned space 16. Indoor temperature sensor 14 is communicably connected to controller 30 in a wireless or wired manner, and outputs information regarding the detected indoor temperature to controller 30. More specifically, indoor temperature sensor 14 includes indoor temperature sensor 14*a* installed in air-conditioned space 16*a*, indoor temperature sensor 14*b* installed in air-conditioned space 16*b*, indoor temperature sensor 14*c* installed in air-conditioned space 16*c*, and indoor temperature sensor 14*d* installed in air-conditioned space 16*d*. Then, indoor temperature sensor 14*a* detects and outputs, to controller 30, the indoor temperature of air-conditioned space 16*a*. Indoor temperature sensor 14*b* detects and outputs, to controller 30, the indoor temperature of air-conditioned space 16*b*. Indoor temperature sensor 14*c* detects and outputs, to controller 30, the indoor temperature of air-conditioned space 16*c*. Indoor temperature sensor 14*d* detects and outputs, to controller 30, the indoor temperature of air-conditioned space 16*d*.

Controller 30 is installed on a wall surface in a room (e.g., air-conditioned space 16*b*) that is a main living space such as a living room, and controls the behavior of air-conditioning unit 1 as control of air-conditioning system 101 based on setting information input and set by the user. Details will be described later.

Figure 2:
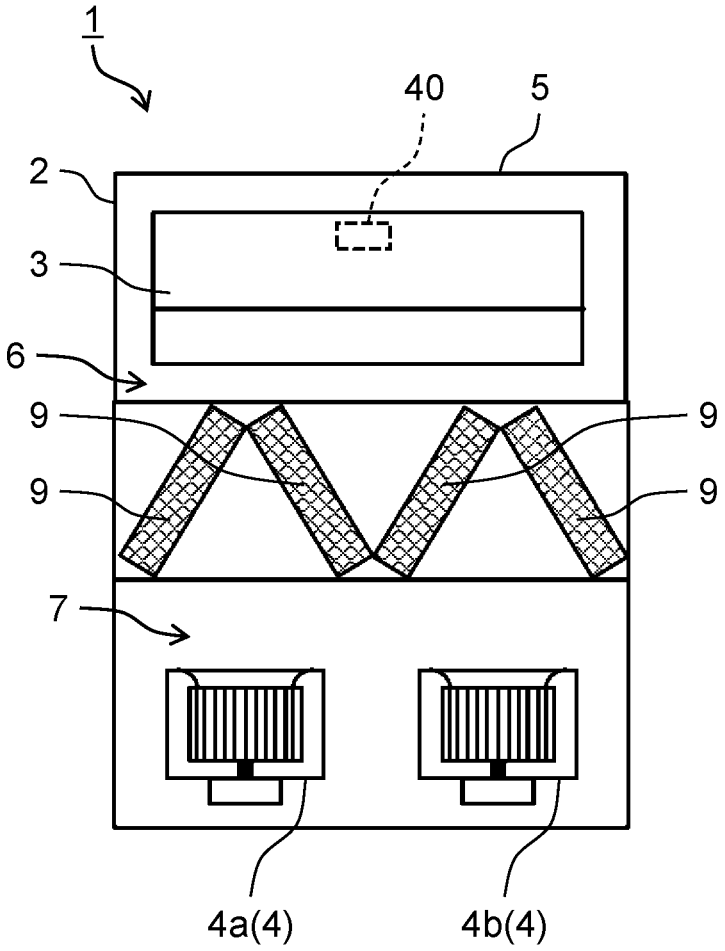
FIG. 2 is a schematic front view of an air-conditioning unit in the air-conditioning system according to the first exemplary embodiment of the present disclosure.

Next, the configuration of air-conditioning unit 1 will be described with reference to FIG. 2. FIG. 2 is a schematic front view of air-conditioning unit 1 of air-conditioning system 101.

As described above, air-conditioning unit 1 is a unit that is installed in dedicated installation space 20, suctions air in house 100 into air-conditioning unit 1, and performs temperature control (cools or raises the temperature) and sends out the suctioned air.

Specifically, as illustrated in FIG. 2, air-conditioning unit 1 includes unit body 2, air-conditioner 3, air blower 4, inlet 5, air-conditioner installation space 6, air blower installation space 7, outlet 8 (see FIG. 3), filter 9, and inlet temperature sensor 40.

Unit body 2 is a housing that forms an outline of air-conditioning unit 1. Inlet 5 is formed on an upper surface side of unit body 2, and outlet 8 (see FIG. 3) is formed on a back surface side of unit body 2. Then, air-conditioner 3, air blower 4, and filter 9 are installed in unit body 2.

Air-conditioner 3 is a device that is installed in air-conditioner installation space 6 positioned on the upper side of unit body 2 and performs air-conditioning of air suctioned into unit body 2 through inlet 5. Air-conditioner 3 is communicably connected to controller 30 in a wireless or wired manner, and performs an air-conditioning behavior (heating operation behavior or cooling operation behavior) based on a control signal from controller 30. Then, air-conditioner 3 raises the temperature of the suctioned air and blows out the air at the time of heating operation, and cools and blows out the suctioned air at the time of cooling operation. Air-conditioner 3 includes inlet temperature sensor 40 that detects the temperature of the air suctioned thereinto.

Air blower 4 is a device that is installed in air blower installation space 7 positioned on the lower side of unit body 2 and sends out the air temperature-controlled by air-conditioner 3 from outlet 8. Air blower 4 is communicably connected to controller 30 in a wireless or wired manner, and the air blowing behavior is controlled by a control signal from controller 30. Then, behavior of air blower 4 forms a series of flow of air by air-conditioning unit 1. That is, the air in house 100 flows through in order of air blower 4, outlet 8, duct 11 (including branch chamber 12), air supply port 15, air-conditioned space 16, common space 17, dedicated installation space 20, inlet 5, air-conditioner installation space 6 (air-conditioner 3), filter 9, and air blower installation space 7 (see FIGS. 1 to 3). More specifically, air blower 4 includes air blower 4*a* that sends out air to air-conditioned spaces 16 (air-conditioned spaces 16*a* and 16*b*) on the second floor and air blower 4*b* that sends out air to air-conditioned spaces 16 (air-conditioned spaces 16*c* and 16*d*) on the first floor. Air blower 4*a* communicates with outlet 8*a* provided on the back surface side of unit body 2, and sends out air temperature-controlled by air-conditioner 3 from air supply ports 15*a* and 15*b* to air-conditioned spaces 16*a* and 16*b* via outlet 8*a* and duct 11*a*. Air blower 4*b* communicates with outlet 8*b* provided on the back surface side of unit body 2, and sends out air temperature-controlled by air-conditioner 3 from air supply ports 15*c* and 15*d* to air-conditioned spaces 16*c* and 16*d* via outlet 8*b* and duct 11*b*.

Inlet 5 is a rectangular shaped opening provided on the upper surface of unit body 2. The rectangular width of inlet 5 is equal to the width of unit body 2. Then, when air blower 4 behaves, inlet 5 suctions the air in dedicated installation space 20. Note that inlet 5 may be provided not only on the upper surface but also in the vicinity of the air inlet of air-conditioner 3.

Air-conditioner installation space 6 is a space in which air-conditioner 3 is installed on the upper side inside unit body 2.

Air blower installation space 7 is a space in which air blower 4 is installed on the lower side inside unit body 2.

Figure 3:
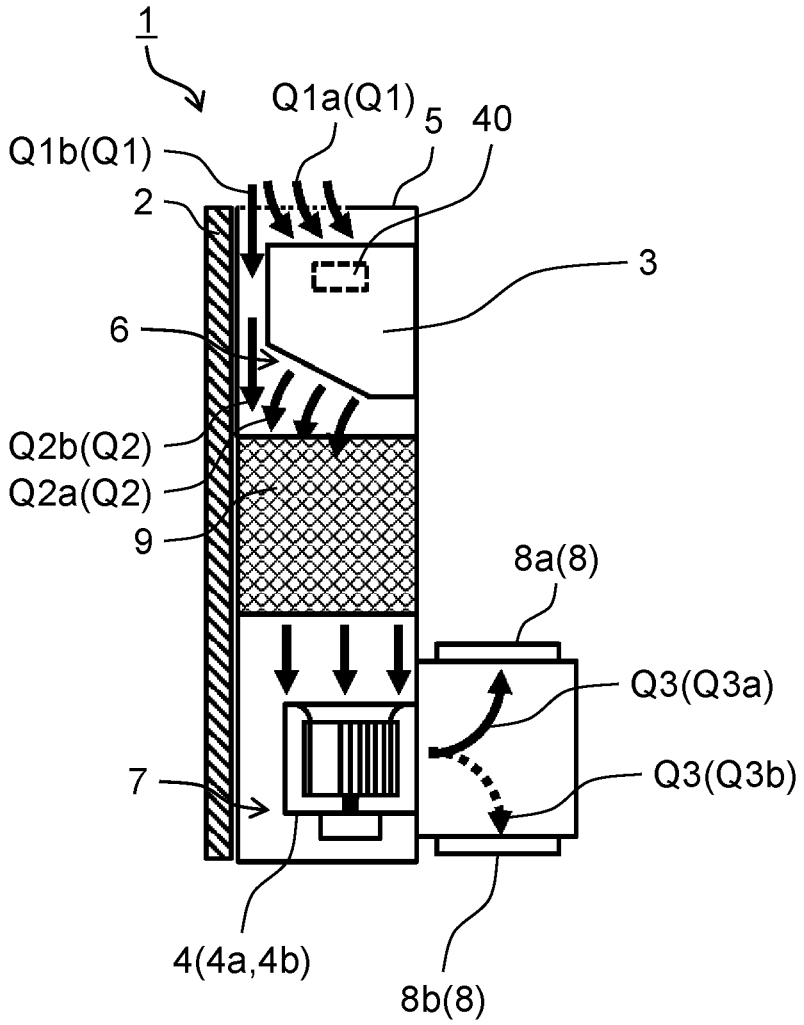
FIG. 3 is a side cross-sectional view of the air-conditioning unit illustrating a flow of air in the air-conditioning system according to the first exemplary embodiment of the present disclosure.

As illustrated in FIG. 3 described later, outlet 8 is an opening that is provided on the back surface side of unit body 2, and through which air temperature-controlled inside unit body 2 is blown out. Outlet 8 is communicably connected to duct 11. More specifically, outlet 8 includes outlet 8*a* communicatively connected to duct 11*a* and outlet 8*b* communicatively connected to duct 11*b*. Outlet 8*a* is opened upward of unit body 2, and outlet 8*b* is opened downward of unit body.

Filter 9 is a member that is installed between air-conditioner installation space 6 and air blower installation space 7, removes fine particles such as dust and dirt in passing air, and performs purification of the air supplied from outlet 8 to air-conditioned space 16 through duct 11. Filter 9 is an air filter such as a high efficiency particulate air (HEPA) filter, for example. Filter 9 has a HEPA filter having a predetermined thickness arranged in an M shape in order to secure a dust collection area inside unit body 2.

Inlet temperature sensor 40 is installed in the inlet of air-conditioner 3 and detects the temperature ("inlet temperature" of claim 1) of the air suctioned by air-conditioner 3. Inlet temperature sensor 40 is communicably connected to controller 30 in a wireless or wired manner, and outputs information regarding the detected inlet temperature to controller 30.

As described above, air-conditioning unit 1 is configured by each member, and performs temperature control and sends out, from outlet 8, the air suctioned from inlet 5.

Next, a flow of air by air-conditioning unit 1 will be described with reference to FIG. 3. FIG. 3 is a side sectional view of air-conditioning unit 1 illustrating the flow of air.

As illustrated in FIG. 3, air-conditioning unit 1 takes in, through inlet 5, air Q1 from air-conditioned space 16. Then, air Q1 taken in is suctioned into air-conditioner 3, temperature-controlled (cooled or heated) inside, and blown out into air-conditioner installation space 6 as air Q2. Air Q2 blown out circulates through filter 9 and flows into air blower installation space 7. Then, air Q2 is sent out as air Q3 from outlet 8 via air blower 4. More specifically, air Q2 is sent out as air Q3*a* from outlet 8*a* via air blower 4*a* and sent out as air Q3*b* from outlet 8*b* via air blower 4*b* at respective air blow volumes controlled by controller 30.

Air Q3 sent out is branched and supplied to each of air-conditioned spaces 16 via duct 11 (see FIG. 1). Note that when the air blow volume of air blower 4 is larger than the air volume (blow out air volume) blown out of air-conditioner 3, air Q1 taken into air-conditioning unit 1 through inlet 5 is divided into air Q1*a* circulating through air-conditioner 3 and flowing into air-conditioner installation space 6 as air Q2*a* and air Q1*b* flowing into air-conditioner installation space 6 as air Q2*b* without circulating through air-conditioner 3.

Figure 4:
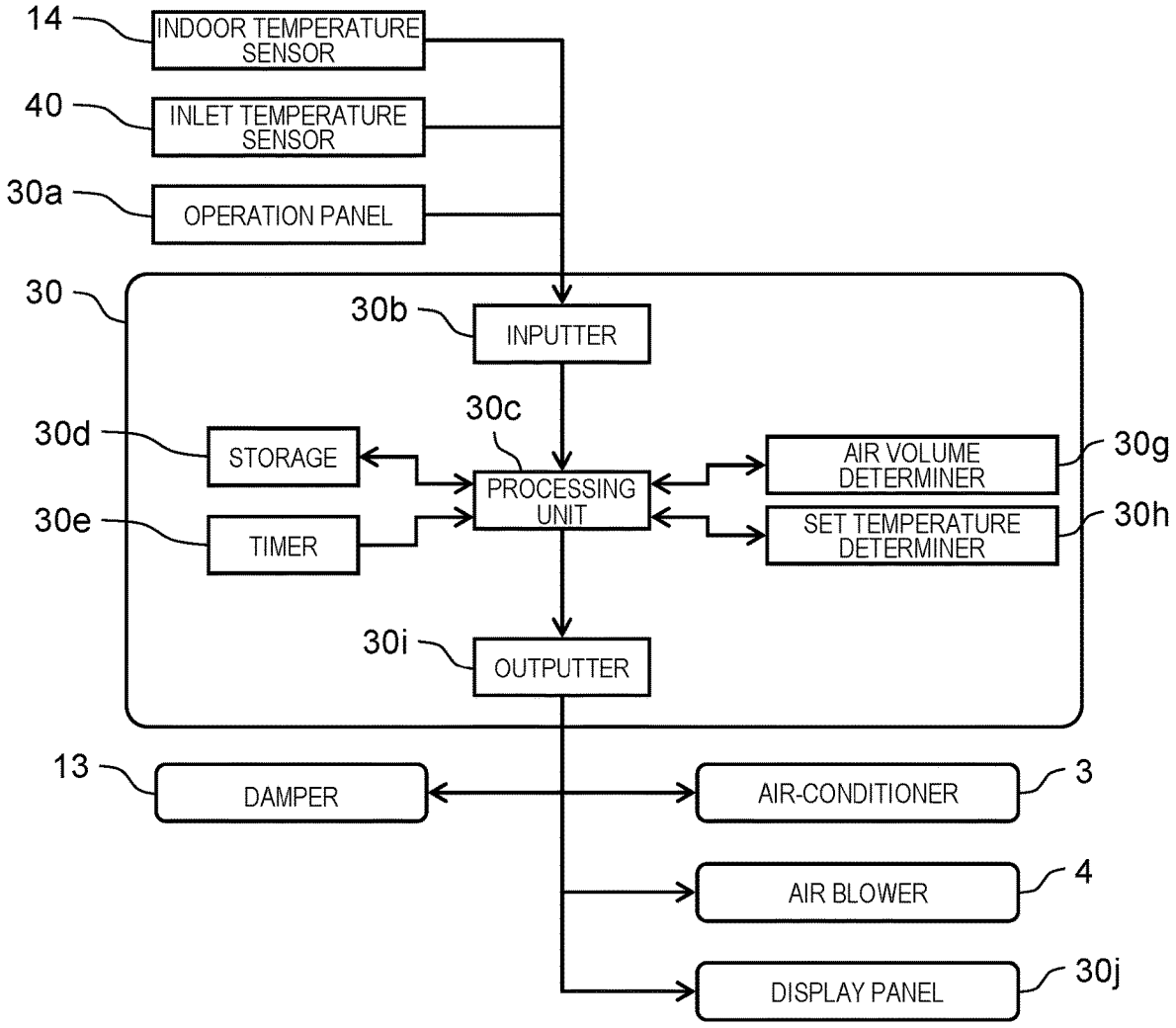
FIG. 4 is a functional block diagram of a controller in the air-conditioning system according to the first exemplary embodiment of the present disclosure.

Next, controller 30 in air-conditioning system 101 will be described with reference to FIG. 4. FIG. 4 is a functional block diagram of controller 30 in air-conditioning system 101.

Controller 30 is installed on a wall surface in a room that is a main living space such as a living room of house 100, and controls the behavior of air-conditioning unit 1 (air-conditioner 3 and air blower 4). Controller 30 is installed at a height of about a human face from the floor of a room in order to facilitate the operation by the user. Controller 30 has a rectangular shape, and includes display panel 30*j* in a front central region of the body and operation panel 30*a* in a right region of display panel 30*j*.

Display panel 30*j* is a liquid crystal monitor or the like, and displays a behavior situation, set temperature, set air volume, current indoor temperature of air-conditioned space 16, and the like of air-conditioning unit 1 on a display screen.

Operation panel 30*a* is a button switch or the like for the user to input a set temperature (hereinafter, also called "indoor set temperature"), a set air volume, and the like with respect to air-conditioned space 16.

Then, controller 30 stores a control unit including a central processing unit (CPU), a memory, and the like of the computer in the body.

Specifically, the control unit of controller 30 includes inputter 30*b*, processing unit 30*c*, storage 30*d*, timer 30*e*, air volume determiner 30*g*, set temperature determiner 30*h*, and outputter 30*i*.

Inputter 30*b* receives information (first information) regarding indoor temperature of air-conditioned space 16 from indoor temperature sensor 14, information (second information) regarding inlet temperature of air-conditioner 3 from inlet temperature sensor 40, and information (third information) regarding input setting of the user from operation panel 30*a*. Inputter 30*b* outputs the received first information to third information to processing unit 30*c*.

Storage 30*d* stores data to be referred to or updated by processing unit 30*c*. For example, storage 30*d* stores an algorithm for determining the behavior aspects of air-conditioner 3 and air blower 4. Storage 30*d* chronologically stores the first information to the third information received by inputter 30*b*. Then, storage 30*d* outputs the stored data (storage data) to processing unit 30*c* in response to a request from processing unit 30*c*.

Timer 30*e* is used for measurement of time as necessary in a program executed by processing unit 30*c*. Then, timer 30*e* outputs data (time data) indicating current time to processing unit 30*c*.

Processing unit 30*c* receives the first information to the third information from inputter 30*b*, the storage data from storage 30*d*, and the time data from timer 30*e*. Processing unit 30*c* specifies an air-conditioning requirement amount required for air-conditioned space 16 at regular time intervals (e.g., 5 minutes) using the received information. More specifically, processing unit 30*c* specifies the air-conditioning requirement amount individually required for each of air-conditioned spaces 16*a* to 16*d* based on a temperature difference between the indoor set temperature stored in storage 30*d* and the indoor temperature detected by indoor temperature sensors 14*a* to 14*d* installed in air-conditioned spaces 16*a* to 16*d* at regular time intervals based on the time data acquired from timer 30*e*. Processing unit 30*c* updates the display of display panel 30*j* via outputter 30*i* in accordance with a change in the information displayed on display panel 30*j*.

Air volume determiner 30*g* acquires the information regarding the air-conditioning requirement amount from processing unit 30*c*, and determines the blow out air volume of air-conditioner 3 based on the mean value or the total value of the air-conditioning requirement amount. Air volume determiner 30*g* determines the air blow volumes of air blowers 4 (air blower 4*a* and air blower 4*b*) based on the respective mean values or the respective total values of the air-conditioning requirement amounts of the first floor and the second floor. Then, air volume determiner 30*g* outputs, to processing unit 30*c*, information regarding the determined blow out air volume of air-conditioner 3 (blow out air volume information) and information regarding the determined air blow volume of air blower 4 (air blow volume information).

Set temperature determiner 30*h* acquires the air-conditioning requirement amount and the information (second information) regarding the inlet temperature of air-conditioner 3 from processing unit 30*c*, and determines the air-conditioner set temperature of air-conditioner 3 based on the mean value or the total value of the air-conditioning requirement amount and the inlet temperature of air-conditioner 3. Set temperature determiner 30*h* outputs information (air-conditioner set temperature information) regarding the determined air-conditioner set temperature of air-conditioner 3 to processing unit 30*c*. Details of a determination method of air-conditioner set temperature will be described later.

Processing unit 30*c* receives blow out air volume information and air blow volume information from air volume determiner 30*g* and air-conditioner set temperature information from set temperature determiner 30*h*. Processing unit 30*c* specifies control information regarding each behavior of air-conditioner 3 and air blower 4 (air blower 4*a* and air blower 4*b*) using received information. Processing unit 30*c* outputs the specified control information to outputter 30*i*.

Outputter 30*i* outputs the control information received from processing unit 30*c* to each of air-conditioner 3 and air blower 4 (air blower 4*a* and air blower 4*b*).

Then, air-conditioner 3 executes the air-conditioning behavior with the air-conditioning set temperature and the blow out air volume based on the control information in accordance with the control information output from outputter 30*i*. Air blower 4 (air blower 4*a* and air blower 4*b*) executes the air blowing behavior at each air blow volume based on the control information in accordance with the control information output from outputter 30*i*.

As described above, controller 30 executes each behavior of the devices of air-conditioning unit 1.

Figure 5:
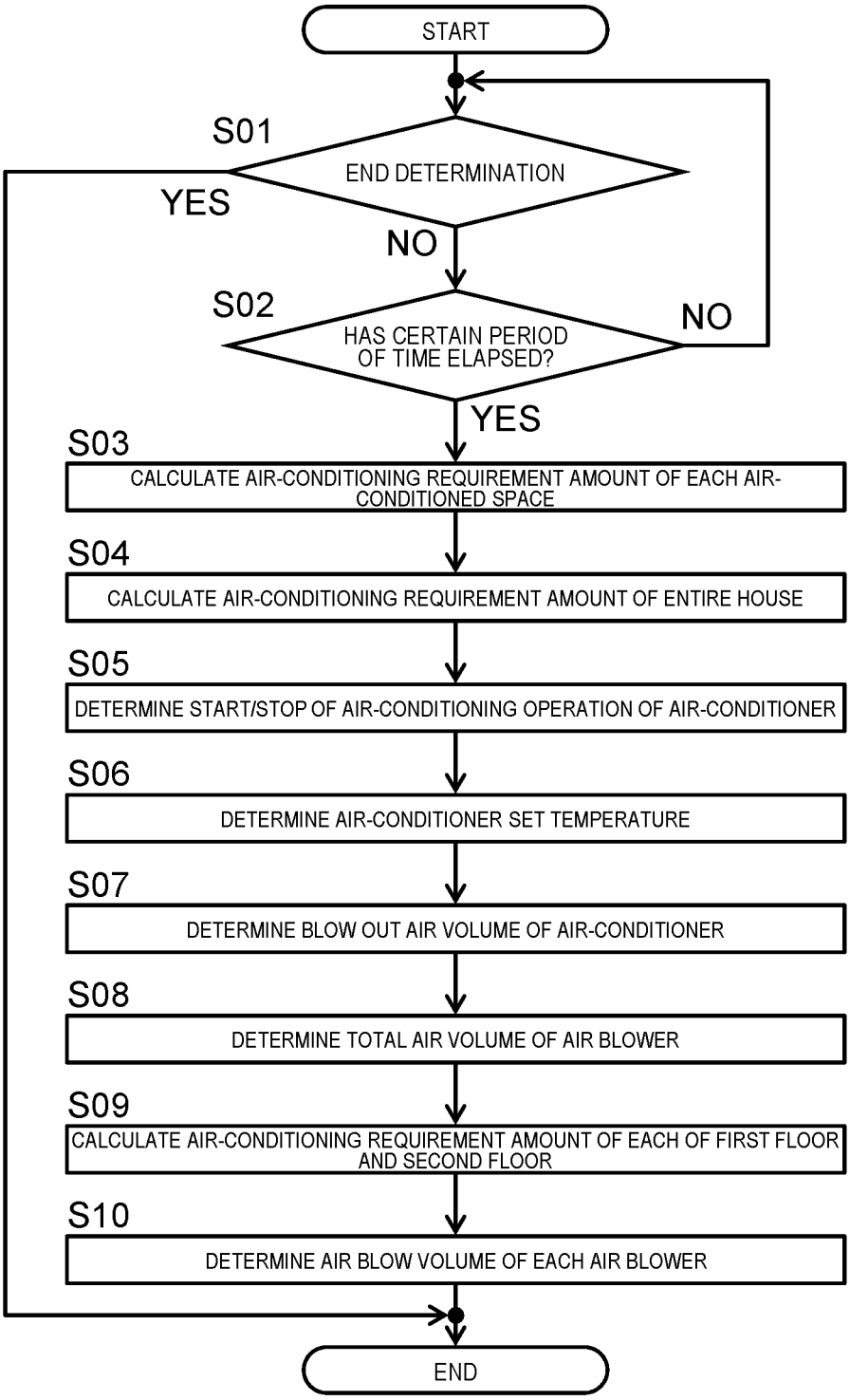
FIG. 5 is a flowchart showing a basic processing behavior of the controller in the air-conditioning system according to the first exemplary embodiment of the present disclosure.

Next, a basic behavior of controller 30 will be described with reference to FIG. 5. FIG. 5 is a flowchart showing basic processing behavior of controller 30.

First, controller 30 performs end determination of air-conditioning system 101 (step S01). As a result, when the power supply of air-conditioning system 101 is off (or input of behavior stop instruction of air-conditioning system 101 from operation panel 30*a*) (YES in step S01), the behavior of air-conditioning system 101 is ended. On the other hand, when the power supply of air-conditioning system 101 is on (NO in step S01), determination of a time lapse is performed (step S02). As a result, when a certain period of time (e.g., 3 minutes) has not elapsed since last processing (NO in step S02), controller 30 returns to step S01. On the other hand, when the certain period of time has elapsed since the last processing (YES in step S02), the process proceeds to step S03, and output determination processing of air-conditioner 3 and air blower 4 is performed.

First, controller 30 calculates the air-conditioning requirement amount for each of air-conditioned spaces 16*a* to 16*d* (step S03). The processing of step S03 will be described in more detail with air-conditioned space 16*a* as an example. In step S03, controller 30 specifies the air-conditioning requirement amount of air-conditioned space 16*a* as a temperature difference between the indoor temperature acquired from indoor temperature sensor 14*a* and the indoor set temperature set in air-conditioned space 16*a*. More specifically, the air-conditioning requirement amount is specified based on a value in which the indoor temperature is subtracted from the indoor set temperature at the time of heating operation, and is specified based on a value in which the indoor set temperature is subtracted from the indoor temperature at the time of cooling operation. This means that the air-conditioning is required for air-conditioned space 16*a* as the air-conditioning requirement amount is larger at a positive value. The air-conditioning requirement amount is provided with a lower limit value and an upper limit value. When the temperature difference between the indoor temperature and the indoor set temperature falls below the lower limit value, the lower limit value is the air-conditioning requirement amount. When the temperature difference between the indoor temperature and the indoor set temperature exceeds the upper limit value, the upper limit value is the air-conditioning requirement amount. In the present exemplary embodiment, the lower limit value is −2° C., and the upper limit value is 3° C.

Next, controller 30 calculates the air-conditioning requirement amount (hereinafter, also called overall air-conditioning requirement amount) of overall house 100 based on the air-conditioning requirement amount of each air-conditioned space 16 (step S04). In the present exemplary embodiment, the overall air-conditioning requirement amount of house 100 is calculated based on the mean value of the air-conditioning requirement amounts of the respective air-conditioned spaces 16.

Subsequently, controller 30 performs determination on operation start/stop of air-conditioner 3 based on the calculated overall air-conditioning requirement amount of house 100 (step S05). Details will be described later.

Subsequently, controller 30 determines the air-conditioner set temperature of air-conditioner 3 based on the calculated overall air-conditioning requirement amount of house 100 and the inlet temperature of the air-conditioner (step S06). Details will be described later.

Next, controller 30 determines the blow out air volume of air-conditioner 3 in accordance with the calculated overall air-conditioning requirement amount of house 100 (step S07). Controller 30 controls the blow out air volume of air-conditioner 3 to be larger as the overall air-conditioning requirement amount is higher. In the present exemplary embodiment, the blow out air volume is 500 $m^3$/h when the overall air-conditioning requirement amount is less than 0° C., the blow out air volume is 700 $m^3$/h when the overall air-conditioning requirement amount is greater than or equal to 0° C. and less than 1° C., and the blow out air volume is 1200 $m^3$/h when the overall air-conditioning requirement amount is greater than or equal to 2° C.

Subsequently, controller 30 determines the total air blow volume of air blower 4 to become equal to or slightly larger than the blow out air volume of air-conditioner 3 (step S08). In other words, controller 30 determines the air volume difference between the total air blow volume of air blower 4 and the blow out air volume of air-conditioner 3 to become less than or equal to a reference air volume. Due to this, controller 30 suppresses the power consumption of air blower 4.

Next, controller 30 calculates the air-conditioning requirement amount of each of the first floor and the second floor (step S09). In the present exemplary embodiment, the mean values of the air-conditioning requirement amounts of air-conditioned spaces 16 of the first floor and the second floor are the air-conditioning requirement amounts of the respective floors.

Subsequently, the air blow volume of air blower 4 is determined based on the air-conditioning requirement amount calculated in step S09 (step S10). Controller 30 determines the air blow volume of air blower 4 of each of the first floor and the second floor so as to give an air volume ratio in accordance with the ratio of the air-conditioning requirement amounts. Specifically, when the air-conditioning requirement amount of the second floor is 1° C., the air-conditioning requirement amount of the first floor is 2° C., and the total air blow volume of air blower 4 determined in step S07 is 1200 $m^3$/h, controller 30 determines that the air blow volume of air blower 4*a* of the second floor is 400 $m^3$/h and the air volume of air blower 4*b* of the first floor is 800 $m^3$/h so that the air volume ratio between air blowers 4 becomes 1:2. Due to this, even when there is a difference in the air-conditioning requirement amounts between the first floor and the second floor, the difference given in the air blow volumes of air blower 4 gives a difference in conveyed heat amounts, and the heat amount equivalent to the air-conditioning requirement amount can be conveyed for both the first floor and the second floor. Note that when the air-conditioning requirement amount falls below 0.5° C. and has a value close to 0 or a negative value, the air volume ratio is calculated with the air-conditioning requirement amount being 0.5° C.

Figure 6:
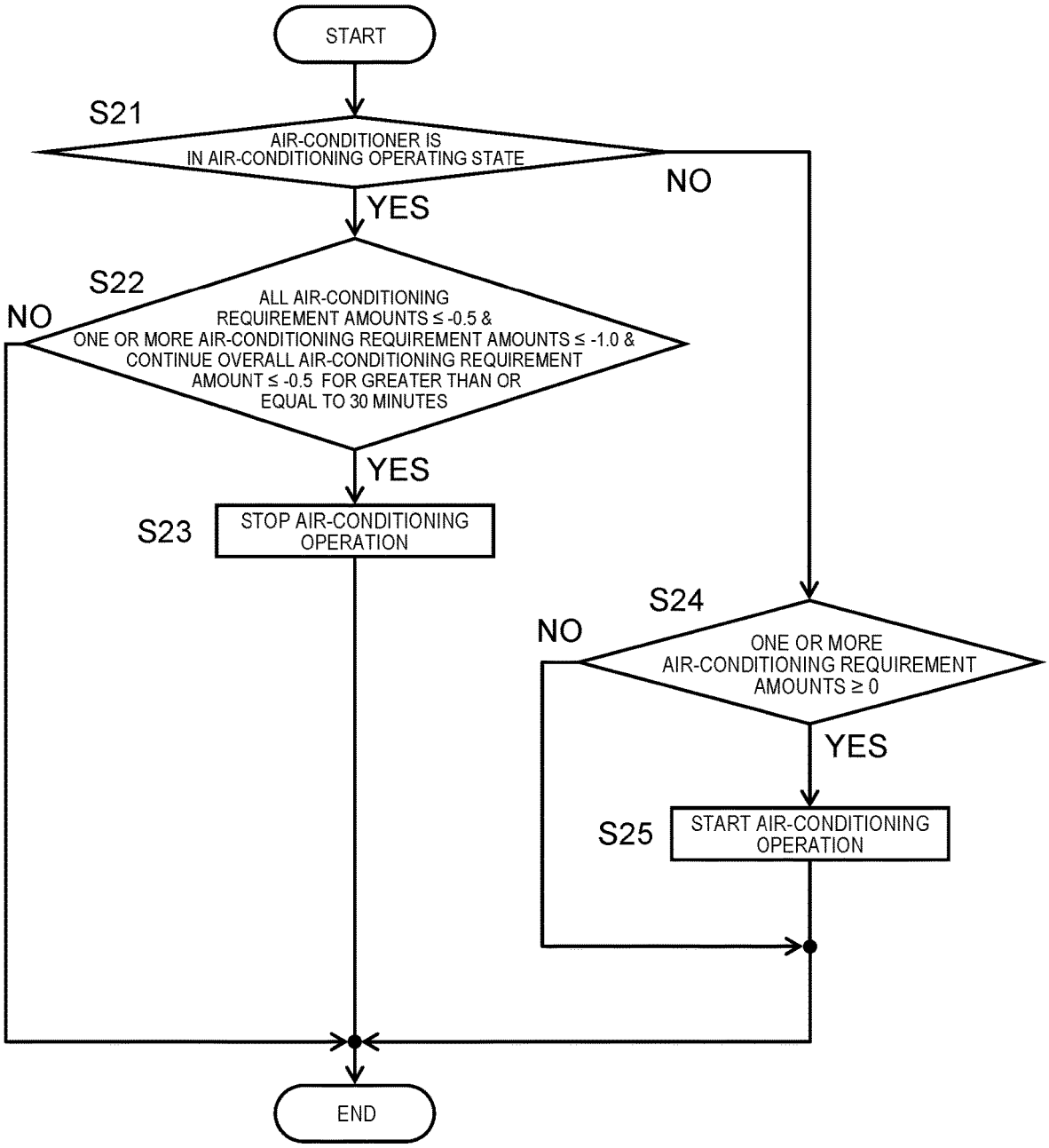
FIG. 6 is a flowchart showing a control behavior of operation start/stop of an air-conditioner of the controller in the air-conditioning system according to the first exemplary embodiment of the present disclosure.

Next, the behavior when controller 30 performs the operation start/stop control of air-conditioner 3 will be described with reference to FIG. 6. FIG. 6 is a flowchart showing the control behavior of operation start/stop of air-conditioner 3 of controller 30.

Figure 8:
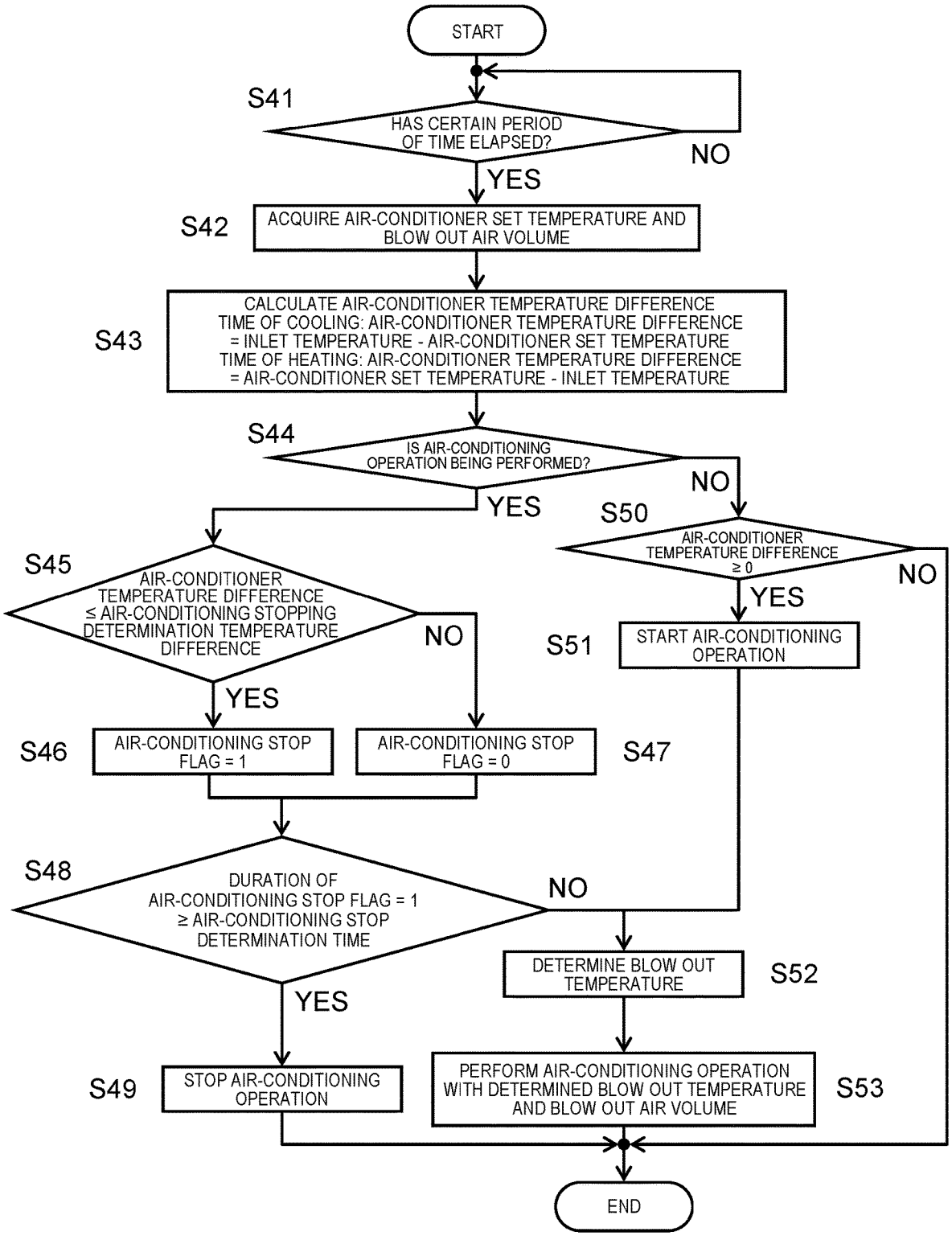
FIG. 8 is a flowchart showing an operation behavior of the air-conditioner in the air-conditioning system according to the first exemplary embodiment of the present disclosure.

In the present exemplary embodiment, air-conditioning system 101 performs control of the operation/stop of air-conditioner 3 only by an instruction from controller 30 without using the air-conditioning operation/stop determination of air-conditioner 3 itself illustrated in FIG. 8 described later. Doing so can prevent air-conditioner 3 from unintentionally stopping and can perform stable control of air-conditioner 3.

Controller 30 performs control to stop the air-conditioning operation of air-conditioner 3 when all of the following three stop conditions are satisfied.

<Stop Condition>

Condition 1: The air-conditioning requirement amounts of all air-conditioned spaces 16 are less than or equal to −0.5° C.

Condition 2: The air-conditioning requirement amount of at least one of air-conditioned spaces 16 is less than or equal to −1.0° C.

Condition 3: A state where the overall air-conditioning requirement amount is less than or equal to −0.5° C. continues for greater than or equal to 30 minutes.

Here, Condition 1 means that all air-conditioned spaces 16 sufficiently satisfy the set temperature set for air-conditioned spaces 16. Condition 1 corresponds to the "first condition" in the claims, and −0.5° C. corresponds to the "first reference temperature" in the claims. Condition 2 means that air-conditioning is performed at a temperature exceeding the set temperature by greater than or equal to 1° C. in one or more air-conditioned spaces. Condition 2 corresponds to the "second condition" in the claims, and −1.0° C. corresponds to the "second reference temperature" in the claims. Condition 3 means that air-conditioner 3 is behaved at the possible lowest output that does not stop the air-conditioning. Condition 3 corresponds to the "third condition" in the claims, and −0.5° C. corresponds to the "third reference temperature" in the claims.

Although details will be described later, when the overall air-conditioning requirement amount is less than or equal to −0.5° C., air-conditioner 3 performs the air-conditioning operation at an air-conditioner temperature difference of about −0.5° C. In the present exemplary embodiment, in an operating state where the air-conditioner temperature difference is less than or equal to 0° C., air-conditioner 3 performs the air-conditioning operation in a state where the air-conditioning output is minimum. At the time of the air-conditioning operation start, air-conditioner 3 performs the air-conditioning operation with a slightly higher output than the minimum output. Therefore, unless Condition 3 exists, the air-conditioning operation is performed at a high output at the time of the air-conditioning operation start, whereby the temperature change of air-conditioned space 16 increases, Condition 1 and Condition 2 are immediately satisfied, the air-conditioning operation is stopped, and the start/stop operation is performed. With Condition 3, the air-conditioning operation is continued for at least 30 minutes. Furthermore, when the outside air load allows the temperature of air-conditioned space 16 to be kept constant by the air-conditioning operation at the minimum output, Condition 1 or Condition 2 is not satisfied, and therefore the air-conditioning operation can be continued.

Subsequently, the control behavior of the operation start/stop will be described in more detail with reference to the flowchart of FIG. 6. First, controller 30 performs determination as to whether air-conditioner 3 is currently performing the air-conditioning operation or stopping the air-conditioning operation (step S21). If air-conditioner 3 is in the operating state (YES in step S21), it is determined whether or not the above-described three stop conditions (Condition 1 to Condition 3) are satisfied (step S22). As a result of the determination, if the three stop conditions are not satisfied (No in step S22), the air-conditioning operation of air-conditioner 3 is continued, and the present control behavior is ended. On the other hand, if the three stop conditions are satisfied (YES in step S22), the air-conditioning operation of air-conditioner 3 is stopped (step S23). Then, the present control behavior is ended.

On the other hand, if air-conditioner 3 is in the stopped state (NO in step S21), it is determined whether or not an air-conditioning start condition is satisfied (step S24). More specifically, it is determined whether or not the air-conditioning requirement amount of at least one of air-conditioned spaces 16 is greater than or equal to 0° C. (corresponding to the "fourth reference temperature" in the claims). As a result of the determination, if the air-conditioning start condition is satisfied (YES in step S24), the air-conditioning operation of air-conditioner 3 is started (step S25), and the present control behavior is ended. On the other hand, if the air-conditioning start condition is not satisfied (NO in step S24), the stop state is continued, and the present control behavior is ended. Note that since the air-conditioning requirement amount indicates the degree of air-conditioning shortage, a positive value of the air-conditioning requirement amount means that air-conditioning is insufficient. That is, when at least one room has insufficient air-conditioning, controller 30 starts the air-conditioning operation of air-conditioner 3. By doing so, no room has insufficient air-conditioning, and therefore the operation can be continued without impairing comfort.

Figures 7A, 7B:
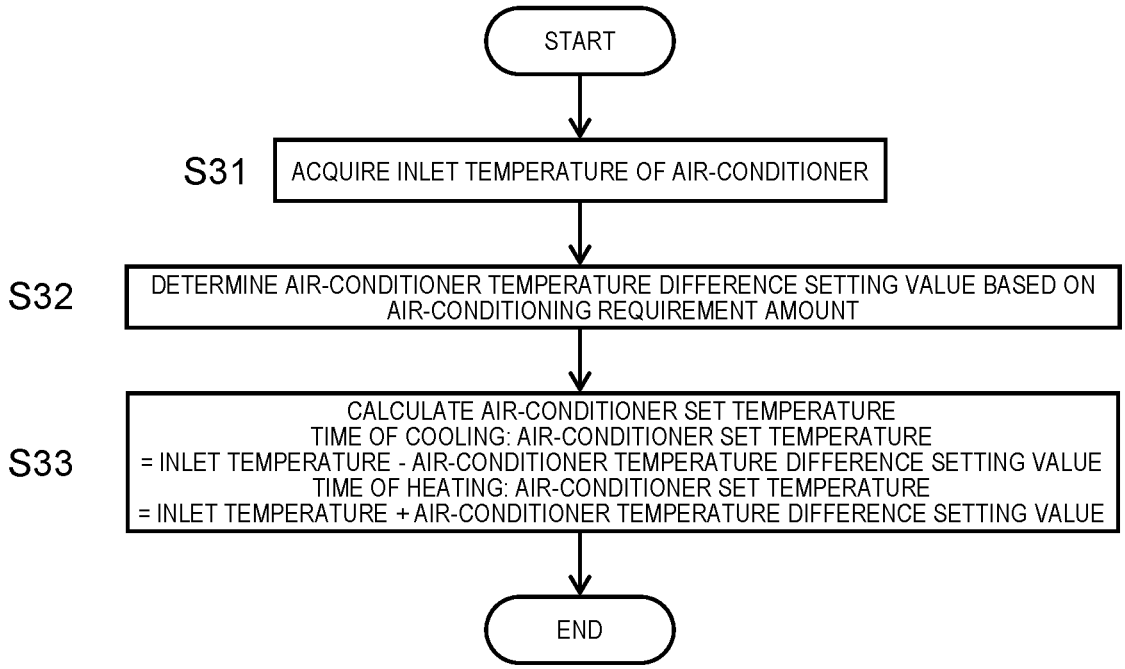
FIG. 7A is a flowchart showing a determination behavior of an air-conditioner set temperature of the controller in the air-conditioning system according to the first exemplary embodiment of the present disclosure.
FIG. 7B is a view illustrating a determination table for determining an air-conditioner temperature difference setting value based on an air-conditioning requirement amount.

Next, a specification method of the air-conditioner set temperature of controller 30 will be described with reference to FIGS. 7A and 7B. FIG. 7A is a flowchart showing a determination behavior of the air-conditioner set temperature of controller 30. FIG. 7B is a determination table for determining the air-conditioner temperature difference setting value based on the air-conditioning requirement amount.

Since air-conditioning system 101 includes the plurality of air-conditioned spaces 16, the inlet temperature of air-conditioner 3 and the temperature of each air-conditioned space 16 do not necessarily coincide with each other. Therefore, the air-conditioner set temperature needs to be set different from the indoor set temperature set in air-conditioned space 16.

First, controller 30 acquires the inlet temperature of air-conditioner 3 from inlet temperature sensor 40 (step S31). Next, in accordance with the determination table illustrated in FIG. 7B, the air-conditioner temperature difference setting value is determined from the overall air-conditioning requirement amount calculated in step S04 of FIG. 5 (step S32). At this time, a determination table in which the air-conditioner temperature difference setting value becomes a value larger than an air-conditioner stop determination temperature difference (−1.5° C. in the present exemplary embodiment) described later is used. Subsequently, the air-conditioner set temperature is determined with the inlet temperature and the air-conditioner temperature difference setting value (step S33). More specifically, a value in which the air-conditioner temperature difference setting value is added to the inlet temperature is the air-conditioner set temperature in a case of heating operation, and a value in which the air-conditioner temperature difference setting value is subtracted from the inlet temperature is the air-conditioner set temperature in a case of cooling operation. In the present exemplary embodiment, air-conditioner 3 is assumed to be a general room air-conditioner, and therefore the air-conditioner set temperature is often a value in increments of 0.5° C. or 1.0° C. In this case, the value is rounded down or rounded off so that the value calculated from the inlet temperature and the air-conditioner temperature difference setting value becomes a value in increments of 0.5° C. or 1.0° C. In the present exemplary embodiment, the air-conditioner set temperature is determined in increments of 0.5° C.

Description will be made using specific numerals.

Assume a case where the inlet temperature is 20.7° C. and the overall air-conditioning requirement amount is 1.2° C. at the time of heating operation. The air-conditioner temperature difference setting value is 1.0° C. from the determination table. At this time, the air-conditioner set temperature is calculated as 20.7+1.0=21.7° C. Since the air-conditioner set temperature is in increments of 0.5° C., the calculated value is divided by 0.5, rounded off to the first decimal place, and then multiplied by 0.5 to be converted into a value in increments of 0.5. 21.7/0.5=43.4, which is rounded off to the first decimal place to be 43.0. 43.0×0.5=21.5, and the air-conditioner set temperature is determined to be 21.5° C. As described above, controller 30 determines the air-conditioner set temperature. When the air-conditioner set temperature is converted in accordance with the increment width, in order to correspond to the difference between the air-conditioner set temperatures before and after the conversion, the air-conditioner temperature difference setting value in the determination table needs to be set to be larger than the air-conditioning stopping determination temperature difference by greater than or equal to the increment width. For example, when the increment width is 0.5° C., it is necessary to use a determination table in which the air-conditioner temperature difference setting value becomes larger than the air-conditioning stopping determination temperature difference +0.5° C. By doing so, even when the air-conditioner temperature difference setting value is different from a value of the air-conditioner temperature difference described later, the air-conditioner temperature difference no longer becomes less than or equal to the air-conditioning stopping determination temperature difference, and air-conditioner 3 can be suppressed from stopping the air-conditioning operation.

Next, the operation behavior of air-conditioner 3 will be described in detail with reference to FIG. 8. FIG. 8 is a flowchart showing the operation behavior of air-conditioner 3.

In the present exemplary embodiment, air-conditioner 3 is assumed to be a general room air-conditioner, and, based on a control signal from controller 30, air-conditioner 3 itself performs determination and control the air-conditioning behavior. Specifically, air-conditioner 3 calculates a difference (hereinafter called "air-conditioner temperature difference") between the inlet temperature detected by inlet temperature sensor 40 and the air-conditioner set temperature given from controller 30, and performs control such that the larger the value of the air-conditioner temperature difference is, the lower the blow out temperature of air-conditioner 3 is at the time of cooling operation and the higher the blow out temperature is at the time of heating operation. By doing this, when the air-conditioner temperature difference becomes large, the inlet temperature, that is, the temperature of the air-conditioning target space for air-conditioner 3 gets close to the set temperature more quickly.

Air-conditioner 3 performs start/stop determination of the air-conditioning operation based on the value of the air-conditioner temperature difference separately from the instruction of operation start/stop from controller 30. This stops the air-conditioning when the air-conditioner temperature difference becomes small, and prevents the air-conditioning from becoming excessive.

First, air-conditioner 3 performs determination of time lapse (step S41). As a result, if the certain period of time (e.g., 30 seconds) has not elapsed since the last processing (NO in step S41), air-conditioner 3 returns to step S41. On the other hand, when the certain period of time has elapsed since the last processing (YES in step S41), the process proceeds to step S42, and start/stop determination of the air-conditioning operation and determination processing of blow out temperature and blow out air volume.

First, air-conditioner 3 acquires the air-conditioner set temperature and the blow out air volume from controller 30 (step S42). When the air-conditioner is used not in air-conditioning system 101 but as a general room air-conditioner, the air-conditioner set temperature and the blow out air volume are acquired not from controller 30 but by remote control input from the user or the like.

Next, air-conditioner 3 calculates the air-conditioner temperature difference (step S43). More specifically, the air-conditioner temperature difference is specified based on a value in which the air-conditioner set temperature is subtracted from the inlet temperature at the time of cooling operation, and is specified based on a value in which the inlet temperature is subtracted from the air-conditioner set temperature at the time of heating operation. This means that the larger the air-conditioner temperature difference is at a positive value, the more air-conditioning is needed.

Next, air-conditioner 3 performs determination as to whether or not the air-conditioning operation is being performed (step S44). As a result, if the air-conditioning operation is being performed (YES in step S44), the process proceeds to step S45 and a stop determination of the air-conditioning operation is performed. On the other hand, if the air-conditioning operation is stopped (NO in step S44), the process proceeds to step S50, and a start determination of the air-conditioning operation is performed.

In step S45, air-conditioner 3 determines whether or not the air-conditioner temperature difference is larger than the air-conditioning stopping determination temperature difference. As a result, if the air-conditioner temperature difference is less than or equal to the air-conditioning stopping determination temperature difference (YES in step S45), an air-conditioning stop flag is "1" (step S46). If the air-conditioner temperature difference is larger than the air-conditioning stopping determination temperature difference (NO in step S45), the air-conditioning stop flag is "0" (step S47).

Next, air-conditioner 3 performs the stop determination of the air-conditioning operation in step S48. If the time (duration) in which the air-conditioning stop flag is "1" has continued for longer than or equal to air-conditioning stop determination time (YES in step S48), air-conditioner 3 stops the air-conditioning operation (step S49). On the other hand, if the air-conditioning stop flag=0 or the time in which the air-conditioning stop flag=1 is continued is shorter than the air-conditioning stop determination time (NO in step S48), air-conditioner 3 continues the air-conditioning operation, proceeds to step S52, and performs determination of the blow out temperature (step S52). Note that in the present exemplary embodiment, the air-conditioner stop determination temperature difference is −1.5° C., and the air-conditioning stop determination time is 3 minutes.

The behavior of the air-conditioning stop determination will be described in detail with the time of heating operation as an example.

For example, when a state where the air-conditioner set temperature is 20° C. and the inlet temperature is 22° C. is continued for 3 minutes, the air-conditioner temperature difference is 20° C.−22° C.=−2° C., which is less than or equal to the air-conditioner stop determination temperature difference of −1.5° C., and therefore the air-conditioning stop flag is "1". Then, since the duration of the air-conditioning stop flag=1 becomes greater than or equal to the air-conditioning stop determination time of 3 minutes, air-conditioner 3 stops the air-conditioning operation. In a case where the inlet temperature changes from 22° C. to 21° C. within 3 minutes at the time of heating operation, the air-conditioner temperature difference becomes 20° C.−21° C.=−1° C., which exceeds the air-conditioning stopping determination temperature difference, therefore, the air-conditioning stop flag becomes "0", and thus air-conditioner 3 continues the air-conditioning operation. Also in a case where the inlet temperature does not change from 22° C. and the air-conditioner set temperature changes from 20° C. to 21° C. during 3 minutes of the heating operation, the air-conditioner temperature difference becomes 21° C.−22° C.=−1° C., which exceeds the air-conditioning stopping determination temperature difference, therefore, the air-conditioning stop flag is "0", and thus air-conditioner 3 continues the air-conditioning operation.

If air-conditioner 3 is in an operation stop state in step S44 (NO in step S44), air-conditioner 3 performs a start determination of the air-conditioning operation (step S50). Specifically, whether or not the air-conditioner temperature difference is greater than or equal to 0 is determined. As a result of the determination, if the air-conditioner temperature difference is greater than or equal to 0 (YES in step S50), air-conditioner 3 starts the air-conditioning operation (step S51), proceeds to step S52, and performs determination of the blow out temperature. On the other hand, if the air-conditioner temperature difference is less than 0 (NO in step S50), air-conditioner 3 continues the air-conditioning stop state, and ends the present control behavior.

When air-conditioner 3 is in the operating state, air-conditioner 3 performs determination of the blow out temperature in step S52. The blow out temperature is determined such that the larger the value of the air-conditioner temperature difference is, the lower the blow out temperature of air-conditioner 3 is at the time of cooling operation, and the higher the blow out temperature is at the time of heating operation. For example, when the air-conditioner set temperature is 23° C. and the inlet temperature is 22° C. at the time of heating operation, the air-conditioner temperature difference becomes 1° C. At this time, air-conditioner 3 performs the air-conditioning behavior with the blow out temperature being 30° C. Subsequently, when the inlet temperature changes from 22° C. to 20° C., the air-conditioner temperature difference increases from 1° C. to 3° C., and air-conditioner 3 increases the blow out temperature to 40° C. to perform air-conditioning.

Next, air-conditioner 3 performs the air-conditioning operation, and blows air having the blow out temperature determined in step S52 with the blow out air volume acquired in step S42 (step S53).

Next, the behavior when air-conditioner 3 is used in air-conditioning system 101 will be described using a specific example.

By determining the air-conditioner temperature difference setting value as a value larger than the air-conditioner stop determination temperature difference (−1.5° C. in the present exemplary embodiment) in step S32 of FIG. 7A, air-conditioner 3 can be behaved so that the air-conditioner temperature difference becomes always larger than the air-conditioner stop determination temperature difference. That is, since the air-conditioner temperature difference always exceeds the air-conditioner stop determination temperature difference, the determination in step S45 in FIG. 8 always becomes NO determination (determination that the air-conditioner temperature difference is larger than the air-conditioning stopping determination temperature difference), and the air-conditioning stop flag is always "0". As a result, since the determination in step S48 also always becomes NO determination, the stop determination in step S49 is not started. When controller 30 determines the air-conditioner set temperature, air-conditioner 3 always behaves in order of step S45, step S47, step S48, step S52, and step S53. That is, air-conditioner 3 does not start the air-conditioning stop determination and continues the air-conditioning operation at all times.

The time of heating operation will be specifically described as an example.

Assume that the indoor set temperature of air-conditioned space 16 is 20° C. and the temperature of all air-conditioned spaces 16 is 20.6° C. The air-conditioning requirement amount at this time is −0.6° C., and the air-conditioner temperature difference setting value becomes −0.5° C. according to the determination table illustrated in FIG. 7B. Assume that the inlet temperature of air-conditioner 3 at this time is 21.1° C., controller 30 calculates the air-conditioner set temperature as 21.1° C.+(−0.5° C.)=20.6° C., converts it in increments of 0.5° C., and determines the air-conditioner set temperature as 20.5° C. Air-conditioner 3 determines the air-conditioner temperature difference to be 20.5° C.−21.1° C.=−0.6° C. from the air-conditioner set temperature and the inlet temperature given by controller 30. At this time, when the inlet temperature fluctuates from 21.1° C. to become 22.0° C., controller 30 updates the air-conditioner set temperature according to step S33 to give 22.0° C.+(−0.5° C.)=21.5° C. Therefore, the air-conditioner temperature difference is 21.5° C.−22.0° C.=−0.5° C., and the temperature difference greater than or equal to the air-conditioning stopping determination temperature difference (−1.5° C.) is kept.

If the control in step S33 is not performed when the inlet temperature fluctuates from 21.0° C. to become 22.0° C., the air-conditioner set temperature remains at 20.5° C., the air-conditioner temperature difference is 20.5° C.−22.0° C.=−1.5° C. (=air-conditioning stopping determination temperature difference), and if this state continues for greater than or equal to the air-conditioning stop determination time (3 minutes), air-conditioner 3 stops the air-conditioning operation.

Thus, in the conventional air-conditioning system that does not perform the control illustrated in FIG. 7A, when the inlet temperature fluctuates, air-conditioner 3 may stop, and air-conditioner 3 behaves with a large power consumption such as repeating operation and stop. In air-conditioning system 101 illustrated in the present exemplary embodiment, by performing the control illustrated in FIG. 7, it is possible to continuously operate air-conditioner 3 even if the inlet temperature fluctuates, and it is possible to suppress deterioration of power consumption.

As described above, air-conditioning system 101 according to the present first exemplary embodiment can achieve the following effects.

(1) Air-conditioning system 101 includes air-conditioning unit 1 that supplies air-conditioned air to the plurality of spaces (air-conditioned spaces 16), unit body 2 that forms an outline of air-conditioning unit 1, air-conditioner 3 that performs temperature control of air taken into unit body 2, one or more air blowers 4 that blow, to the outside of unit body 2, air blown out from air-conditioner 3, and controller 30 that controls air-conditioner 3. Then, controller 30 (i) determines the air-conditioner set temperature such that the air-conditioner temperature difference, which is a temperature difference between an inlet temperature, which is a temperature of air suctioned by air-conditioner 3, and the air-conditioner set temperature set to air-conditioner 3, has a value larger than the air-conditioning stopping determination temperature difference, and (ii) causes air-conditioner 3 to perform an air-conditioning operation with the air-conditioner set temperature having been determined.

According to such configuration, since air-conditioner 3 behaves in a state where the air-conditioner temperature difference is larger than the air-conditioner set temperature, the COP is improved by air-conditioner 3 continuously operating without stopping, and the energy saving performance is improved.

(2) In air-conditioning system 101, controller 30 determines the air-conditioning requirement amount for each of the plurality of air-conditioned spaces 16 based on the temperature difference between the temperature of air-conditioned space 16 and the indoor set temperature set for air-conditioned space 16. Then, the operation of air-conditioner 3 is stopped when all of the first condition in which the air-conditioning requirement amount having been determined becomes less than or equal to the first reference temperature (e.g., −0.5° C.) in all of air-conditioned spaces 16, the second condition in which the air-conditioning requirement amount having been determined becomes less than or equal to the second reference temperature (e.g., −1.0° C.) in at least one of air-conditioned spaces 16 (e.g., air-conditioned space 16*a*), and the third condition in which the air-conditioning operating time of air-conditioner 3 becomes greater than or equal to a predetermined time (e.g., 30 minutes) in a state where the mean value (overall air-conditioning requirement amount) of the air-conditioning requirement amounts having been determined becomes less than or equal to the third reference temperature (e.g., −0.5° C.) are satisfied. Due to this, the air-conditioning operation of air-conditioner 3 is stopped only when all air-conditioned spaces 16 are sufficiently air-conditioned, when the air-conditioning becomes excessive in at least one air-conditioned space 16, and when a state where the output of the air-conditioning operation of air-conditioner 3 is minimum continues for a predetermined time. Therefore, air-conditioning system 101 is suppressed from excessively air-conditioning, and the air-conditioning operation of air-conditioner 3 is continued for a predetermined time from the start of the air-conditioning operation until the air-conditioning operation is stopped, and therefore the start/stop operation is suppressed, and the energy saving performance is improved.

(3) In air-conditioning system 101, controller 30 starts air-conditioning operation of air-conditioner 3 in a case where the air-conditioning requirement amount becomes larger than the fourth reference temperature (e.g., 0° C.) in at least one of air-conditioned spaces 16 while air-conditioner 3 is stopping air-conditioning operation. Due to this, air-conditioning system 101 immediately starts the air-conditioning when the air-conditioning is insufficient in at least one of air-conditioned spaces 16, and therefore can achieve energy saving without impairing comfort.

The present disclosure has been described in the foregoing based on the exemplary embodiment. It is understood by those skilled in the art that the exemplary embodiments are merely examples, that the components or the treatment processes can be combined as various modifications, and that such modifications also fall within the scope of the present disclosure.

Second Exemplary Embodiment

Patent Literature 2 discloses an operation method for eliminating an upper and lower temperature difference generated at the time of heating operation of an air-conditioning system that is installed in a house, is embedded in a ceiling, and discharges air downward. The conventional air-conditioning system adjusts the air discharge direction and promotes circulation by changing the orientation of a louver including a rotation mechanism while stopping heating operation and performing operation of only air blowing.

Such conventional air-conditioning system is difficult to install in a building such as a multidwelling unit where a sufficient space for embedding an air-conditioner in the space above the ceiling cannot be secured. In other words, the air-conditioning system that discharges air temperature-controlled in an air-conditioning chamber from a discharge port via a duct is excellent in terms of space saving in a height direction. However, even when the duct is used, there is a concern that the air discharged from the discharge port directly hits a person in the room when the discharge port is installed on the ceiling surface. Alternatively, when the discharge port on the ceiling surface includes the rotation mechanism, construction becomes complicated, and there is a concern about a problem of maintenance or wiring trouble. For this reason, an air-conditioning system in which the discharge port is installed on an inner wall surface in the vicinity of the ceiling and air can be blown only in the horizontal direction with respect to the floor surface is often used.

Such air-conditioning system that can blow air only in the horizontal direction with respect to the floor surface has a problem that the upper and lower temperature difference cannot be sufficiently eliminated because the air discharge direction cannot be adjusted.

An object of the present disclosure is to provide an air-conditioning system that can reduce an upper and lower temperature difference in a space at the time of heating operation.

An air-conditioning system according to the present disclosure includes: an air-conditioning unit that supplies air-conditioned air to a plurality of spaces; a unit body that forms an outline of the air-conditioning unit; an air-conditioner that performs temperature control of air taken into the unit body; an air blower that blows, to an outside of unit body, air having been blown out from the air-conditioner; an opening installed on an inner wall surface of the spaces and discharges the opening through which air blown out by the air blower; and a controller that controls the air-conditioner and the air blower such that a temperature of the space becomes a space set temperature. Then, the opening discharges air in the horizontal direction with respect to the floor surface of the space in the vicinity of the ceiling of the space. Then, in the heating operation of the air-conditioner, the controller causes the air-conditioner to behave at a first air volume, causes the air blower to behave at a similar air volume to the first air volume when the temperature difference in which the temperature of the space is subtracted from a space set temperature is greater than or equal to a reference temperature, and causes the air blower to behave at a second air volume larger than the first air volume when the temperature difference is less than the reference temperature, thereby achieving the intended object.

According to the present disclosure, it is possible to provide an air-conditioning system that can reduce an upper and lower temperature difference in a space at the time of heating operation.

Again, an air-conditioning system according to the present disclosure includes: an air-conditioning unit that supplies air-conditioned air to a plurality of spaces; a unit body that forms an outline of the air-conditioning unit; an air-conditioner that performs temperature control of air taken into the unit body; an air blower that blows, to an outside of the unit body, air having been blown out from the air-conditioner; an opening installed on an inner wall surface of the spaces and discharges the opening through which air blown out by the air blower; and a controller that controls the air-conditioner and the air blower such that a temperature of the space becomes a space set temperature. Then, the opening discharges air in the horizontal direction with respect to the floor surface of the space in the vicinity of the ceiling of the space. Then, in the heating operation of the air-conditioner, the controller causes the air-conditioner to behave at a first air volume, causes the air blower to behave at a similar air volume to the first air volume when the temperature difference in which the temperature of the space is subtracted from a space set temperature is greater than or equal to a reference temperature, and causes the air blower to behave at a second air volume larger than the first air volume when the temperature difference is less than the reference temperature.

According to such configuration, when the temperature difference in which the temperature of the space is subtracted from the space set temperature becomes less than the reference temperature, the air volume of the air blower becomes larger than the air volume of the air-conditioner from the first air volume to the second air volume, whereby the air air-conditioned by the air-conditioner and the air outside the air-conditioning unit (air not air-conditioned by the air-conditioner) are mixed and blown from the air blower. Therefore, in addition to the increase in the air volume of the air discharged from the opening of the space, the temperature of the air discharged from the opening of the space decreases, and the buoyancy is reduced, therefore, an airflow flowing from the upper part to the lower part of the space is easily formed, and the upper and lower temperature difference of the space is reduced.

In the air-conditioning system according to the present disclosure, when the temperature difference is greater than or equal to the reference temperature, the controller may be switchable between a first control mode in which the air blower is behaved with a similar same air volume to the first air volume and a second control mode in which the air blower is behaved with a third air volume larger than the second air volume. Due to this, when the temperature difference is large, the blow out temperature of the air-conditioner also increases, but by further increasing the air volume of the air blower from the first air volume to the third air volume, the temperature of the air blown out from the opening of the space decreases, and therefore the effect of the upper and lower temperature difference reduction can be obtained even when the temperature difference is large.

In the air-conditioning system according to the present disclosure, when switching the air volume of the air blower from the first air volume to the second air volume, the controller preferably holds the temperature of the air temperature-controlled by the air-conditioner at a predetermined temperature. Due to this, since the output of the air-conditioner does not change, it is possible to avoid insufficient air-conditioning or excessive air-conditioning, and it is possible to reduce the upper and lower temperature difference of the space while keeping the space at a comfortable temperature.

In the air-conditioning system according to the present disclosure, the opening may be capable of blowing air only in the horizontal direction with respect to the floor surface of the space without including a louver. This enables temperature control of a space with a simpler system, and enables cost reduction.

Hereinafter, the second exemplary embodiment of the present disclosure will be described with reference to the drawings.

Figure 9:
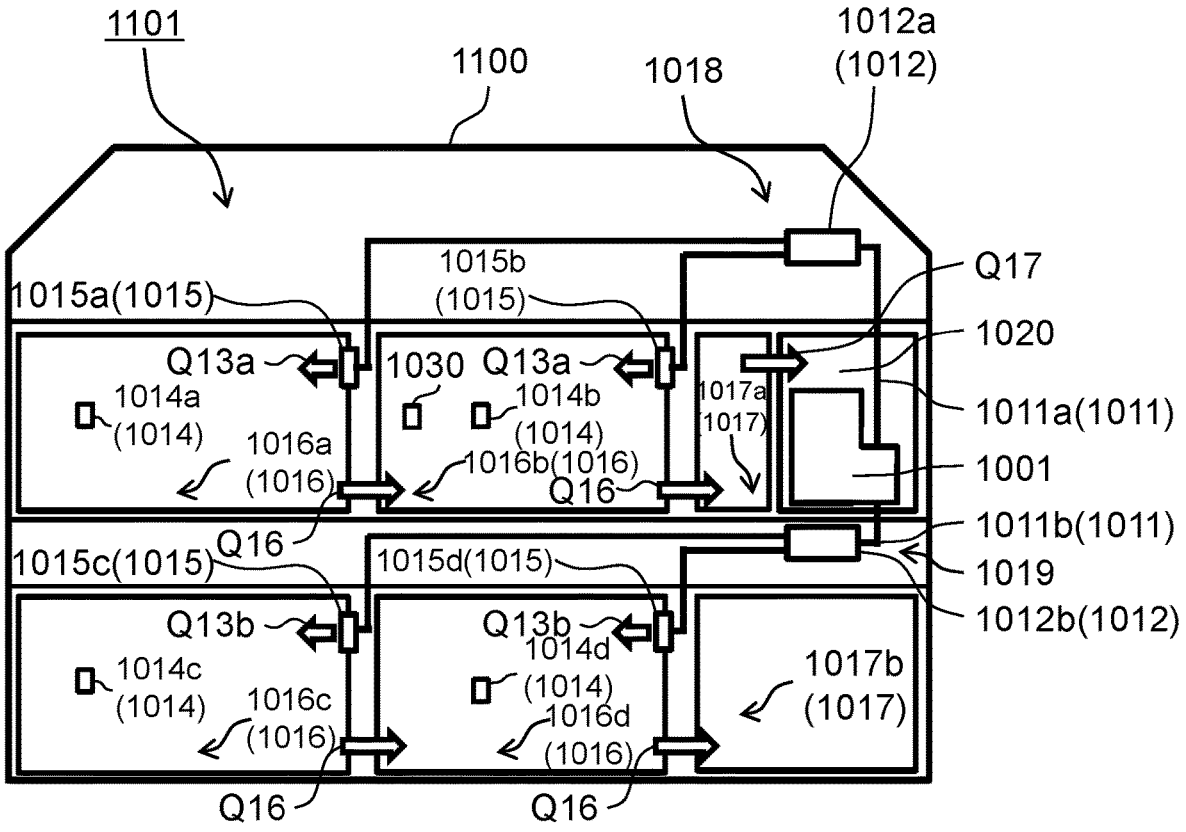
FIG. 9 is a configuration diagram of an air-conditioning system according to a second exemplary embodiment of the present disclosure.

First, an outline of air-conditioning system 1101 according to the second exemplary embodiment of the present disclosure will be described with reference to FIG. 9. FIG. 9 is a configuration diagram of air-conditioning system 1101 according to the second exemplary embodiment of the present disclosure.

Air-conditioning system 1101 is a system for air-conditioning a plurality of spaces in a building with one air-conditioner. As illustrated in FIG. 9, air-conditioning system 1101 is configured to include air-conditioning unit 1001, a plurality of ducts 1011 (ducts 1011*a* and 1011*b*), a plurality of branch chambers 1012 (branch chambers 1012*a* and 1012*b*), space temperature sensor 1014 (space temperature sensors 1014*a* to 1014*d*), air supply port 1015 (air supply ports 1015*a* to 1015*d*), and controller 1030. Then, air-conditioning system 1101 performs air-conditioning of air-conditioned space 1016 described later using the air having been temperature-controlled in air-conditioning unit 1001.

Specifically, air-conditioning system 1101 is installed in house 1100, which is an example of building. House 1100 includes, for example, air-conditioned spaces 1016 (air-conditioned spaces 1016*a* to 1016*d*) corresponding to a room such as a living room, a bedroom, a dining room, a study room, and the like, common space 1017 (common spaces 1017*a* and 1017*b*) corresponding to a corridor, a staircase, an open ceiling, and the like, and dedicated installation space 1020 installed with air-conditioning unit 1001 independently of air-conditioned space 1016 and common space 1017.

Air-conditioned space 1016 is a space that becomes a target of air-conditioning in air-conditioning system 1101. Air-conditioned space 1016 includes air-conditioned spaces 1016*a* and 1016*b* positioned on the second floor of house 1100 and air-conditioned spaces 1016*c* and 1016*d* positioned on the first floor of house 1100. Air-conditioned spaces 1016*a* to 1016*d* are each supplied with temperature-controlled air Q13 from air-conditioning unit 1001 described later.

Common space 1017 is a space that is not a target of air-conditioning in air-conditioning system 1101. Common space 1017 includes common space 1017*a* positioned on the second floor of house 1100 and common space 1017*b* positioned on the first floor of house 1100. Common space 1017*a* and common space 1017*b* are continuous to each other via a stair not illustrated or the like. Similarly to air-conditioned space 1016, common space 1017 may be supplied with temperature-controlled air Q13 from air-conditioning unit 1001 described later.

Dedicated installation space 1020 is a space in which air-conditioning unit 1001 is stored and installed. Dedicated installation space 1020 is provided with a door (not illustrated), and the door faces common space 1017, for example. This enables maintenance of air-conditioning unit 1001 in dedicated installation space 1020 to be easily performed.

Air-conditioning unit 1001 is a unit that is installed in dedicated installation space 1020, suctions air in house 1100 into air-conditioning unit 1001, and performs temperature control (cools or raises the temperature) and sends out the suctioned air. Details will be described later.

Duct 1011 is a member that is provided in an in-wall space such as attic 1018 or space 1019 above the ceiling, and communicably connects air-conditioning unit 1001 and air-conditioned space 1016. Duct 1011 has an inner wall surface or an outer wall surface, for example, subjected to heat insulation processing with glass wool or the like. Then, duct 1011 is provided with branch chamber 1012 on air-conditioning unit 1001 side of duct 1011, and provided with air supply port 1015 on air-conditioned space 1016 side of duct 1011. More specifically, duct 1011 includes duct 1011*a* provided in attic 1018 on the second floor and duct 1011*b* provided in space 1019 above the ceiling on the first floor. Then, duct 1011*a* is provided with branch chamber 1012*a* on air-conditioning unit 1001 side of duct 1011*a*, and provided with air supply ports 1015*a* and 1015*b* on air-conditioned space 1016 side of duct 1011*a*. Duct 1011*b* is provided with branch chamber 1012*b* on air-conditioning unit 1001 side of duct 1011*b*, and provided with air supply ports 1015*c* and 1015*d* on air-conditioned space 1016 side of duct 1011*b*.

Branch chamber 1012 is a chamber that is installed on air-conditioning unit 1001 side of duct 1011 and branches, into a plurality of air-conditioned spaces 1016, air Q13 (temperature-controlled air) sent out from air-conditioning unit 1001. Branch chamber 1012 includes branch chamber 1012*a* provided in duct 1011*a* and branch chamber 1012*b* provided in duct 1011*b*. Then, branch chamber 1012*a* branches, into two systems of air-conditioned space 1016*a* and air-conditioned space 1016*b*, air Q13*a* sent out from air-conditioning unit 1001. Branch chamber 1012*b* branches, into two systems of air-conditioned space 1016*c* and air-conditioned space 1016*d*, air Q13*b* sent out from air-conditioning unit 1001.

Air supply port 1015 is an opening that is installed in the vicinity of the ceiling of air-conditioned space 1016 and blows out, to air-conditioned space 1016 via duct 1011, air Q13 from air-conditioning unit 1001. Air supply port 1015 does not include a louver and discharges air Q13 in the horizontal direction with respect to the floor surface of air-conditioned space 1016. More specifically, air supply port 1015 includes air supply port 1015*a* installed in air-conditioned space 1016*a*, air supply port 1015*b* installed in air-conditioned space 1016*b*, air supply port 1015*c* installed in air-conditioned space 1016*c*, and air supply port 1015*d* installed in air-conditioned space 1016*d*. Then, air supply port 1015*a* and air supply port 1015*b* blow air Q13*a* from air-conditioning unit 1001 to air-conditioned space 1016*a* and air-conditioned space 1016*b*, respectively, via duct 1011*a*. Air supply port 1015*c* and air supply port 1015*d* blow air Q13*b* from air-conditioning unit 1001 to air-conditioned space 1016*c* and air-conditioned space 1016*d*, respectively, via duct 1011*b*. At this time, air supply ports 1015*a* to 1015*d* discharge air in the horizontal direction with respect to the respective floor surfaces of air-conditioned spaces 1016*a* to 1016*d*.

Space temperature sensor 1014 is installed in air-conditioned space 1016 and detects the temperature (space temperature) of the air in air-conditioned space 1016. Space temperature sensor 1014 is communicably connected to controller 1030 in a wireless or wired manner, and outputs information regarding the detected space temperature to controller 1030. More specifically, space temperature sensor 1014 includes space temperature sensor 1014*a* installed in air-conditioned space 1016*a*, space temperature sensor 1014*b* installed in air-conditioned space 1016*b*, space temperature sensor 1014*c* installed in air-conditioned space 1016*c*, and space temperature sensor 1014*d* installed in air-conditioned space 1016*d*. Then, space temperature sensor 1014*a* detects and outputs, to controller 1030, the space temperature of air-conditioned space 1016*a*. Space temperature sensor 1014*b* detects and outputs, to controller 1030, the space temperature of air-conditioned space 1016*b*. Space temperature sensor 1014*c* detects and outputs, to controller 1030, the space temperature of air-conditioned space 1016*c*. Space temperature sensor 1014*d* detects and outputs, to controller 1030, the space temperature of air-conditioned space 1016*d*.

Controller 1030 is installed on a wall surface in a room (e.g., air-conditioned space 1016*b*) that is a main living space such as a living room, and controls the behavior of air-conditioning unit 1001 as control of air-conditioning system 1101 based on setting information input and set by the user. Details will be described later.

The flow of air Q13 blown out from air supply port 1015 will be described. Air Q13 flows from an undercut (not illustrated) of the door of air-conditioned space 1016 into adjacent air-conditioned space 1016 or common space 1017 as air Q16. Air Q16 circulates while being mixed in each air-conditioned space 1016 or common space 1017, and finally flows into dedicated installation space 1020 as air Q17. Air Q17 is mixed with the air in dedicated installation space 1020, and is finally suctioned into air-conditioning unit 1001 as air Q11 (see FIG. 11).

Figure 10:
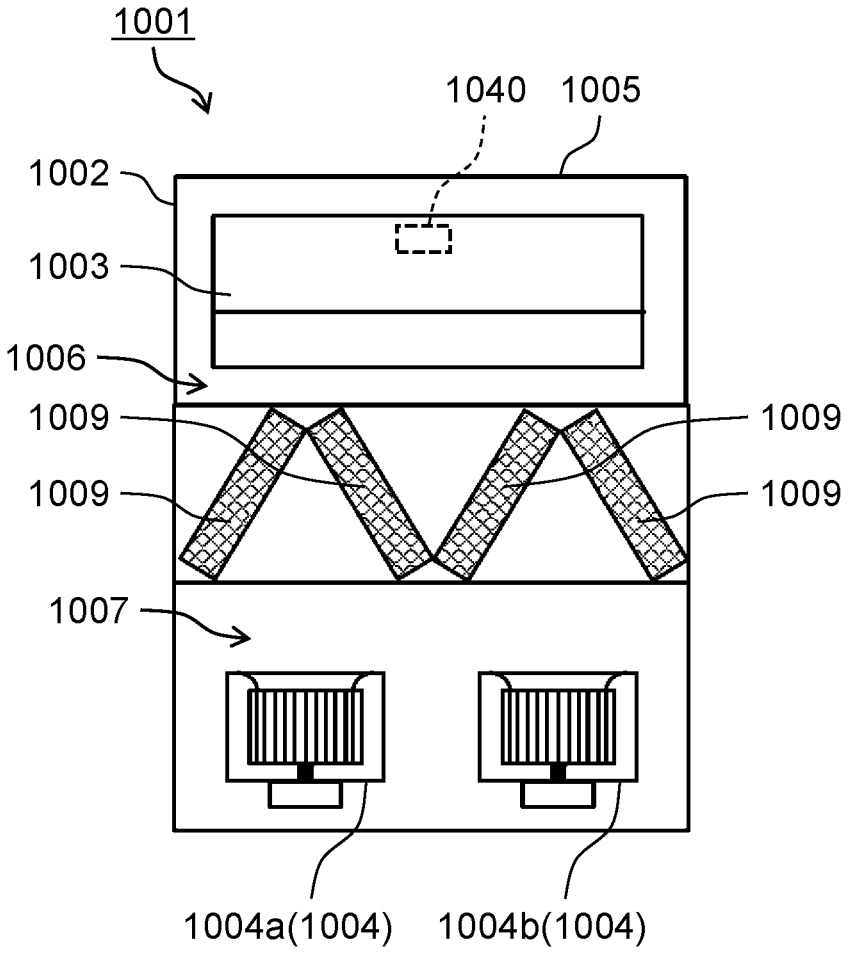
FIG. 10 is a schematic front view of an air-conditioning unit in the air-conditioning system according to the second exemplary embodiment of the present disclosure.

Next, the configuration of air-conditioning unit 1001 will be described with reference to FIG. 10. FIG. 10 is a schematic front view of air-conditioning unit 1001 of air-conditioning system 1101.

As described above, air-conditioning unit 1001 is a unit that is installed in dedicated installation space 1020, suctions air in house 1100 into air-conditioning unit 1001, and performs temperature control (cools or raises the temperature) and sends out the suctioned air.

Specifically, as illustrated in FIG. 10, air-conditioning unit 1001 includes unit body 1002, air-conditioner 1003, air blower 1004, inlet 1005, air-conditioner installation space 1006, air blower installation space 1007, outlet 1008 (see FIG. 11), filter 1009, and inlet temperature sensor 1040.

Unit body 1002 is a housing that forms an outline of air-conditioning unit 1001. Inlet 1005 is formed on an upper surface side of unit body 1002, and outlet 1008 (see FIG. 11) is formed on a back surface side of unit body 1002. Then, air-conditioner 1003, air blower 1004, and filter 1009 are installed in unit body 1002.

Air-conditioner 1003 is a device that is installed in air-conditioner installation space 1006 positioned on the upper side of unit body 1002 and performs air-conditioning of air suctioned into unit body 1002 through inlet 1005. Air-conditioner 1003 is communicably connected to controller 1030 in a wireless or wired manner, and performs an air-conditioning behavior (heating operation behavior or cooling operation behavior) based on a control signal from controller 1030. Then, air-conditioner 1003 raises the temperature of the suctioned air and blows out the air at the time of heating operation, and cools and blows out the suctioned air at the time of cooling operation. Air-conditioner 1003 includes inlet temperature sensor 1040 that detects the temperature of the air suctioned thereinto.

Air blower 1004 is a device that is installed in air blower installation space 1007 positioned on the lower side of unit body 1002 and sends out the air temperature-controlled by air-conditioner 1003 from outlet 1008. Air blower 1004 is communicably connected to controller 1030 in a wireless or wired manner, and the air blowing behavior is controlled by a control signal from controller 1030. Then, behavior of air blower 1004 forms a series of flow of air by air-conditioning unit 1001. That is, the air in house 1100 flows through in order of air blower 1004, outlet 1008, duct 1011 (including branch chamber 1012), air supply port 1015, air-conditioned space 1016, common space 1017, dedicated installation space 1020, inlet 1005, air-conditioner installation space 1006 (air-conditioner 1003), filter 1009, and air blower installation space 1007 (see FIGS. 9 to 11). More specifically, air blower 1004 includes air blower 1004*a* that sends out air to air-conditioned spaces 1016 (air-conditioned spaces 1016*a* and 1016*b*) on the second floor and air blower 1004*b* that sends out air to air-conditioned spaces 1016 (air-conditioned spaces 1016*c* and 1016*d*) on the first floor. Air blower 1004*a* communicates with outlet 1008*a* provided on the back surface side of unit body 1002, and sends out air temperature-controlled by air-conditioner 1003 from air supply ports 1015*a* and 1015*b* to air-conditioned spaces 1016*a* and 1016*b* via outlet 1008*a* and duct 1011*a*. Air blower 1004*b* communicates with outlet 1008*b* provided on the back surface side of unit body 1002, and sends out air temperature-controlled by air-conditioner 1003 from air supply ports 1015*c* and 1015*d* to air-conditioned spaces 1016*c* and 1016*d* via outlet 1008*b* and duct 1011*b*.

Inlet 1005 is a rectangular shaped opening provided on the upper surface of unit body 1002. The rectangular width of inlet 1005 is equal to the width of unit body 1002. Then, when air blower 1004 behaves, inlet 1005 suctions the air in dedicated installation space 1020. Note that inlet 1005 may be provided not only on the upper surface but also in the vicinity of the air inlet of air-conditioner 1003.

Air-conditioner installation space 1006 is a space in which air-conditioner 1003 is installed on the upper side inside unit body 1002.

Air blower installation space 1007 is a space in which air blower 1004 is installed on the lower side inside unit body 1002.

Figure 11:
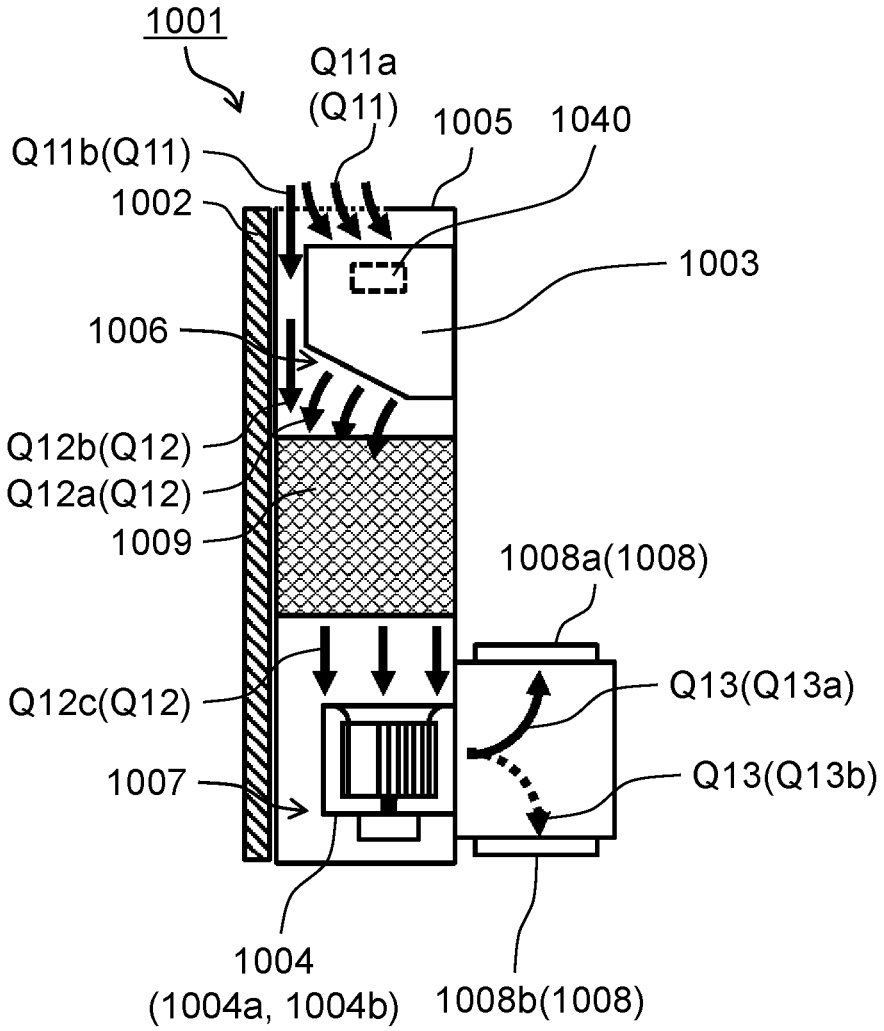
FIG. 11 is a side cross-sectional view of the air-conditioning unit illustrating a flow of air in the air-conditioning system according to the second exemplary embodiment of the present disclosure.

As illustrated in FIG. 11 described later, outlet 1008 is an opening that is provided on the back surface side of unit body 1002, and through which air temperature-controlled inside unit body 1002 is blown out. Outlet 1008 is communicably connected to duct 1011. More specifically, outlet 1008 includes outlet 1008*a* communicatively connected to duct 1011*a* and outlet 1008*b* communicatively connected to duct 1011*b*. Outlet 1008*a* is opened upward of unit body 1002, and outlet 1008*b* is opened downward of unit body.

Filter 1009 is a member that is installed between air-conditioner installation space 1006 and air blower installation space 1007, removes fine particles such as dust and dirt in passing air, and performs purification of the air supplied from outlet 1008 to air-conditioned space 1016 through duct 1011. Filter 1009 is an air filter such as a HEPA filter, for example. Filter 1009 has a HEPA filter having a predetermined thickness arranged in an M shape in order to secure a dust collection area inside unit body 1002.

Inlet temperature sensor 1040 is installed in the inlet of air-conditioner 1003 and detects the temperature of the air suctioned by air-conditioner 1003. Inlet temperature sensor 1040 is communicably connected to controller 1030 in a wireless or wired manner, and outputs information regarding the detected inlet temperature to controller 1030.

As described above, air-conditioning unit 1001 is configured by each member, and performs temperature control and sends out, from outlet 1008, the air suctioned from inlet 1005.

Next, a flow of air by air-conditioning unit 1001 will be described with reference to FIG. 11. FIG. 11 is a side sectional view of air-conditioning unit 1001 illustrating the flow of air.

As illustrated in FIG. 11, air-conditioning unit 1001 takes in, through inlet 1005, air Q17 (see FIG. 9) from air-conditioned space 1016 as air Q11. Then, air Q11 taken in is suctioned into air-conditioner 1003, temperature-controlled (cooled or heated) inside, and blown out into air-conditioner installation space 1006 as air Q12. Air Q12 blown out circulates through filter 1009 and flows into air blower installation space 1007. Then, air Q12 is sent out as air Q13 from outlet 1008 via air blower 1004. More specifically, air Q12 is sent out as air Q13*a* from outlet 1008*a* via air blower 1004*a* and sent out as air Q13*b* from outlet 1008*b* via air blower 1004*b* at respective air blow volumes controlled by controller 1030.

Air Q13 sent out is branched and supplied to each of air-conditioned spaces 1016 via duct 1011 (see FIG. 9). Note that when the air blow volume of air blower 1004 is larger than the air volume (blow out air volume) blown out of air-conditioner 1003, air Q11 taken into air-conditioning unit 1001 through inlet 1005 is divided into air Q11*a* circulating through air-conditioner 1003 and flowing into air-conditioner installation space 1006 as air Q12*a* and air Q11*b* flowing into air-conditioner installation space 1006 as air Q12*b* without circulating through air-conditioner 1003. Thereafter, air Q12*a* and air Q12*b* are mixed in air-conditioner installation space 1006, and are suctioned into air blower 1004 as air Q12*c*.

Figure 12:
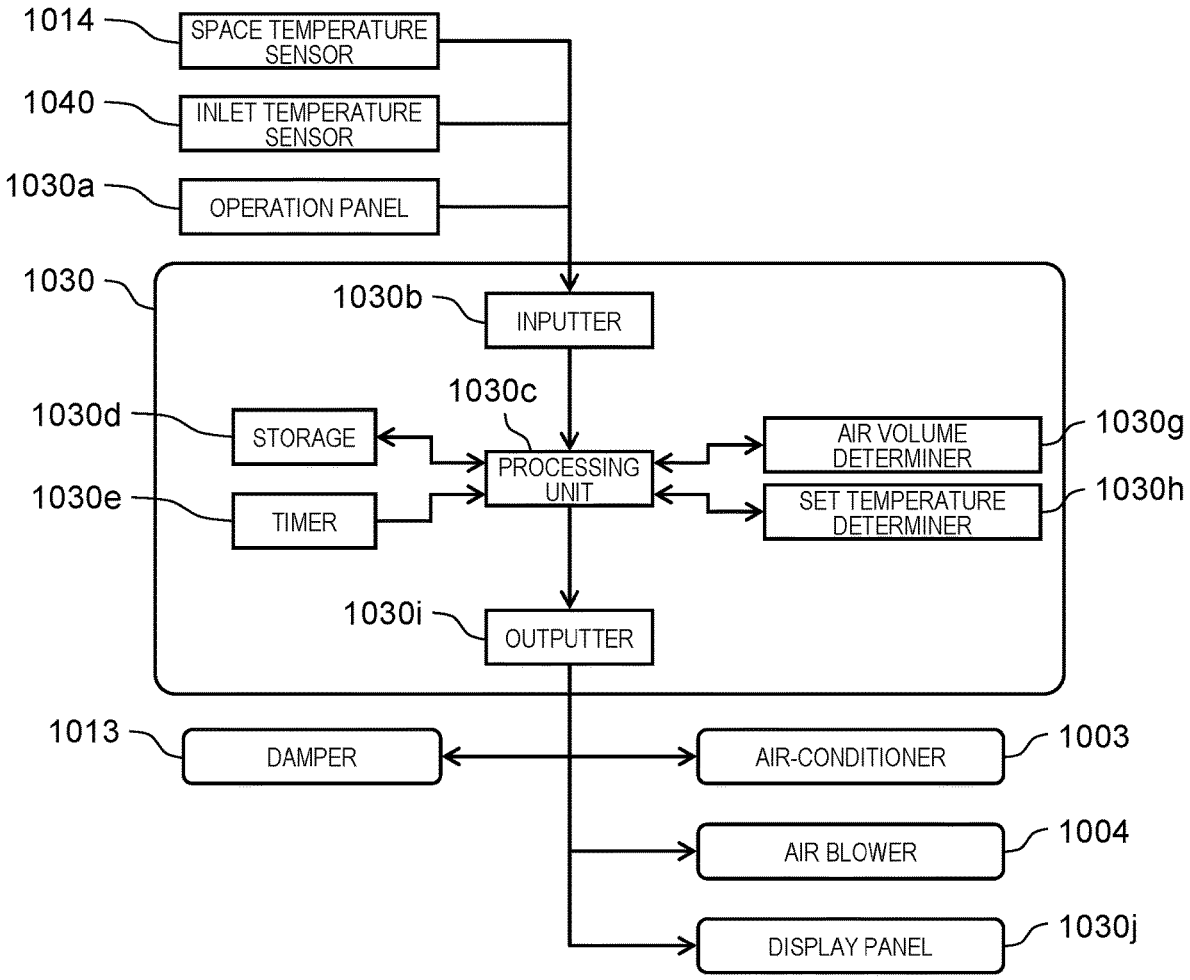
FIG. 12 is a functional block diagram of a controller in the air-conditioning system according to the second exemplary embodiment of the present disclosure.

Next, controller 1030 in air-conditioning system 1101 will be described with reference to FIG. 12. FIG. 12 is a functional block diagram of controller 1030 in air-conditioning system 1101.

Controller 1030 is installed on a wall surface in a room that is a main living space such as a living room of house 1100, and controls the behavior of air-conditioning unit 1001 (air-conditioner 1003 and air blower 1004). Controller 1030 is installed at a height of about a human face from the floor of a room in order to facilitate the operation by the user. Controller 1030 has a rectangular shape, and includes display panel 1030*j* in a front central region of the body and operation panel 1030*a* in a right region of display panel 1030*j*.

Display panel 1030*j* is a liquid crystal monitor or the like, and displays a behavior situation, set temperature, set air volume, current space temperature of air-conditioned space 1016, and the like of air-conditioning unit 1001 on a display screen.

Operation panel 1030*a* is a button switch or the like for the user to input a set temperature (hereinafter, also called "space set temperature"), a set air volume with respect to air-conditioned space 1016, selection information on a control mode (first control mode and second control mode) described later, and the like. Note that the first control mode is also called a normal mode, and the second control mode is also called an upper and lower temperature difference reduction mode.

Then, controller 1030 stores a control unit including a CPU, a memory, and the like of the computer in the body.

Specifically, the control unit of controller 1030 includes inputter 1030*b*, processing unit 1030*c*, storage 1030*d*, timer 1030*e*, air volume determiner 1030*g*, set temperature determiner 1030*h*, and outputter 1030*i*.

Inputter 1030*b* receives information (first information) regarding space temperature of air-conditioned space 1016 from space temperature sensor 1014, information (second information) regarding inlet temperature of air-conditioner 1003 from inlet temperature sensor 1040, and information (third information) regarding input setting of the user from operation panel 1030*a*. Inputter 1030*b* outputs the received first information to third information to processing unit 1030*c*.

Storage 1030*d* stores data to be referred to or updated by processing unit 1030*c*. For example, storage 1030*d* stores an algorithm for determining the behavior aspects of air-conditioner 1003 and air blower 1004. Storage 1030*d* chronologically stores the first information to the third information received by inputter 1030*b*. Then, storage 1030*d* outputs the stored data (storage data) to processing unit 1030*c* in response to a request from processing unit 1030*c*.

Timer 1030*e* is used for measurement of time as necessary in a program executed by processing unit 1030*c*. Then, timer 1030*e* outputs data (time data) indicating current time to processing unit 1030*c*.

Processing unit 1030*c* receives the first information to the third information from inputter 1030*b*, the storage data from storage 1030*d*, and the time data from timer 1030*e*. Processing unit 1030*c* specifies an air-conditioning requirement amount required for air-conditioned space 1016 at regular time intervals (e.g., 5 minutes) using the received information. More specifically, processing unit 1030*c* specifies the air-conditioning requirement amount individually required for each of air-conditioned spaces 1016*a* to 1016*d* based on a temperature difference between the space set temperature stored in storage 1030*d* and the space temperature detected by space temperature sensors 1014*a* to 1014*d* installed in air-conditioned spaces 1016*a* to 1016*d* at regular time intervals based on the time data acquired from timer 1030*e*. Processing unit 1030*c* updates the display of display panel 1030*j* via outputter 1030*i* in accordance with a change in the information displayed on display panel 1030*j*.

Air volume determiner 1030*g* acquires the information regarding the air-conditioning requirement amount from processing unit 1030*c*, and determines the blow out air volume of air-conditioner 1003 based on the mean value or the total value of the air-conditioning requirement amount. Air volume determiner 1030*g* determines the air blow volumes of air blowers 1004 (air blower 1004*a* and air blower 1004*b*) based on the respective mean values or the respective total values of the air-conditioning requirement amounts of the first floor and the second floor. Then, air volume determiner 1030*g* outputs, to processing unit 1030*c*, information regarding the determined blow out air volume of air-conditioner 1003 (blow out air volume information) and information regarding the determined air blow volume of air blower 1004 (air blow volume information).

Set temperature determiner 1030*h* acquires the air-conditioning requirement amount and the information (second information) regarding the inlet temperature of air-conditioner 1003 from processing unit 1030*c*, and determines the air-conditioner set temperature of air-conditioner 1003 based on the mean value or the total value of the air-conditioning requirement amount and the inlet temperature of air-conditioner 1003. Set temperature determiner 1030*h* outputs information (air-conditioner set temperature information) regarding the determined air-conditioner set temperature of air-conditioner 1003 to processing unit 1030*c*. Details of a determination method of air-conditioner set temperature will be described later.

Processing unit 1030*c* receives blow out air volume information and air blow volume information from air volume determiner 1030*g* and air-conditioner set temperature information from set temperature determiner 1030*h*. Processing unit 1030*c* specifies control information regarding each behavior of air-conditioner 1003 and air blower 1004 (air blower 1004*a* and air blower 1004*b*) using received information. Processing unit 1030*c* outputs the specified control information to outputter 1030*i*.

Outputter 1030*i* outputs the control information received from processing unit 1030*c* to each of air-conditioner 1003 and air blower 1004 (air blower 1004*a* and air blower 1004*b*).

Then, air-conditioner 1003 executes the air-conditioning behavior with the air-conditioner set temperature and the blow out air volume based on the control information in accordance with the control information output from outputter 1030*i*. Air blower 1004 (air blower 1004*a* and air blower 1004*b*) executes the air blowing behavior at each air blow volume based on the control information in accordance with the control information output from outputter 1030*i*.

As described above, controller 1030 executes each behavior of the devices of air-conditioning unit 1001.

Figure 13:
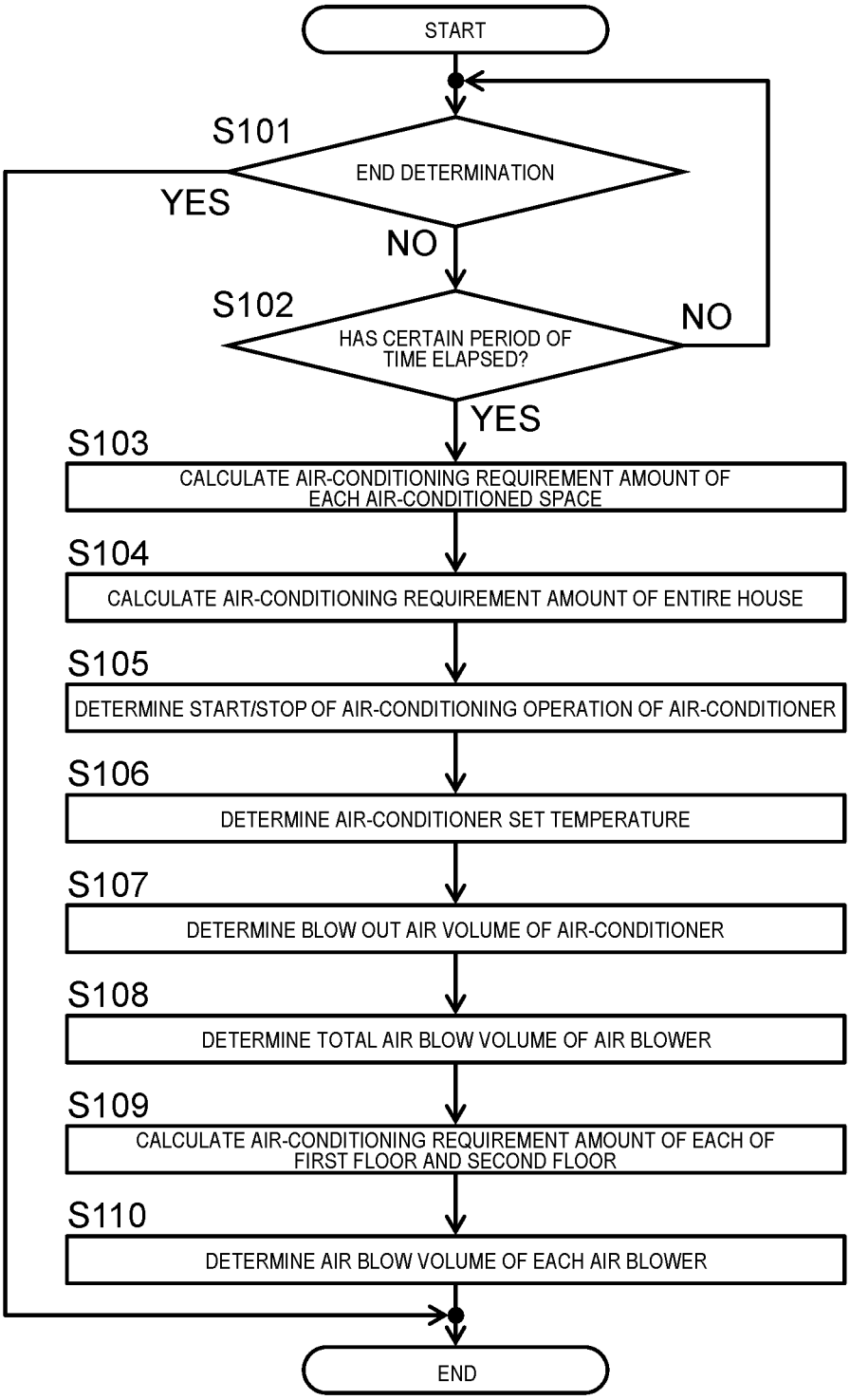
FIG. 13 is a flowchart showing a basic processing behavior of the controller in the air-conditioning system according to the second exemplary embodiment of the present disclosure.

Next, a basic behavior of controller 1030 will be described with reference to FIG. 13. FIG. 13 is a flowchart showing basic processing behavior of controller 1030.

First, controller 1030 performs end determination of air-conditioning system 1101 (step S101). As a result, when the power supply of air-conditioning system 1101 is off (or input of behavior stop instruction of air-conditioning system 1101 from operation panel 1030*a*) (YES in step S101), the behavior of air-conditioning system 1101 is ended. On the other hand, when the power supply of air-conditioning system 1101 is on (NO in step S101), determination of a time lapse is performed (step S102). As a result, when a certain period of time (e.g., 3 minutes) has not elapsed since last processing (NO in step S102), controller 1030 returns to step S101. On the other hand, when the certain period of time has elapsed since the last processing (YES in step S102), the process proceeds to step S103, and output determination processing of air-conditioner 1003 and air blower 1004 is performed.

First, controller 1030 calculates the air-conditioning requirement amount for each of air-conditioned spaces 1016*a* to 1016*d* (step S103). The processing of step S103 will be described in more detail with air-conditioned space 1016*a* as an example. In step S103, controller 1030 specifies the air-conditioning requirement amount of air-conditioned space 1016*a* as a temperature difference between the space temperature acquired from space temperature sensor 1014*a* and the space set temperature set in air-conditioned space 1016*a*. More specifically, the air-conditioning requirement amount is specified based on a value in which the space temperature is subtracted from the space set temperature at the time of heating operation, and is specified based on a value in which the space set temperature is subtracted from the space temperature at the time of cooling operation. This means that the air-conditioning is required for air-conditioned space 1016*a* as the air-conditioning requirement amount is larger at a positive value. The air-conditioning requirement amount is provided with a lower limit value and an upper limit value. When the temperature difference between the space temperature and the space set temperature falls below the lower limit value, the lower limit value is the air-conditioning requirement amount. When the temperature difference between the space temperature and the space set temperature exceeds the upper limit value, the upper limit value is the air-conditioning requirement amount. In the present exemplary embodiment, the lower limit value is −2° C., and the upper limit value is 3° C.

Next, controller 1030 calculates the air-conditioning requirement amount (hereinafter, also called overall air-conditioning requirement amount) of overall house 1100 based on the air-conditioning requirement amount of each air-conditioned space 1016 (step S104). In the present exemplary embodiment, the overall air-conditioning requirement amount of house 1100 is calculated based on the mean value of the air-conditioning requirement amounts of the respective air-conditioned spaces 1016.

Subsequently, controller 1030 performs determination on operation start/stop of air-conditioner 1003 based on the calculated overall air-conditioning requirement amount of house 1100 (step S105). Details will be described later.

Subsequently, controller 1030 determines the air-conditioner set temperature of air-conditioner 1003 based on the calculated overall air-conditioning requirement amount of house 1100 and the inlet temperature of the air-conditioner (step S106). Details will be described later.

Next, controller 1030 determines the blow out air volume of air-conditioner 1003 in accordance with the calculated overall air-conditioning requirement amount of house 1100 (step S107). Controller 1030 controls the blow out air volume of air-conditioner 1003 to be larger as the overall air-conditioning requirement amount is higher. In the present exemplary embodiment, the blow out air volume is 500 $m^3$/h when the overall air-conditioning requirement amount is less than 0° C., the blow out air volume is 700 $m^3$/h when the overall air-conditioning requirement amount is greater than or equal to 0° C. and less than 1° C., and the blow out air volume is 1200 $m^3$/h when the overall air-conditioning requirement amount is greater than or equal to 2° C.

Subsequently, controller 1030 determines the total air blow volume of air blower 1004 (step S108). Although details will be described later, first, controller 1030 determines whether or not the upper and lower temperature difference reduction operation is possible, and determines whether to operate in the first control mode or to operate in the second control mode. In the case of the first control mode, the total air blow volume of air blower 1004 is determined to become equal to or slightly larger than the blow out air volume of air-conditioner 1003. In other words, controller 1030 determines the air volume difference between the total air blow volume of air blower 1004 and the blow out air volume of air-conditioner 1003 to become less than or equal to a reference air volume. Due to this, controller 1030 suppresses the power consumption of air blower 1004.

On the other hand, in the case of the second control mode, the total air blow volume of air blower 1004 is determined to become larger than the blow out air volume of air-conditioner 1003. For example, the total air blow volume of air blower 1004 is determined to become larger than the blow out air volume of air-conditioner 1003 by 250 $m^3$/h.

Next, controller 1030 calculates the air-conditioning requirement amount of each of the first floor and the second floor (step S109). In the present exemplary embodiment, the mean values of the air-conditioning requirement amounts of air-conditioned spaces 1016 of the first floor and the second floor are the air-conditioning requirement amounts of the respective floors.

Subsequently, the air blow volume of air blower 1004 is determined based on the air-conditioning requirement amount calculated in step S109 (step S110). Controller 1030 determines the air blow volume of air blower 1004 of each of the first floor and the second floor so as to give an air volume ratio in accordance with the ratio of the air-conditioning requirement amounts. Specifically, when the air-conditioning requirement amount of the second floor is 1° C., the air-conditioning requirement amount of the first floor is 2° C., and the total air blow volume of air blower 1004 determined in step S107 is 1200 $m^3$/h, controller 1030 determines that the air blow volume of air blower 1004*a* of the second floor is 400 $m^3$/h and the air volume of air blower

1004*b* of the first floor is 800 $m^3$/h so that the air volume ratio between air blowers 1004 becomes 1:2. Due to this, even when there is a difference in the air-conditioning requirement amounts between the first floor and the second floor, the difference given in the air blow volumes of air blowers 1004 gives a difference in conveyed heat amounts, and the heat amount equivalent to the air-conditioning requirement amount can be conveyed for both the first floor and the second floor. Note that when the air-conditioning requirement amount falls below 0.5° C. and has a value close to 0 or a negative value, the air volume ratio is calculated with the air-conditioning requirement amount being 0.5° C.

Figure 14:
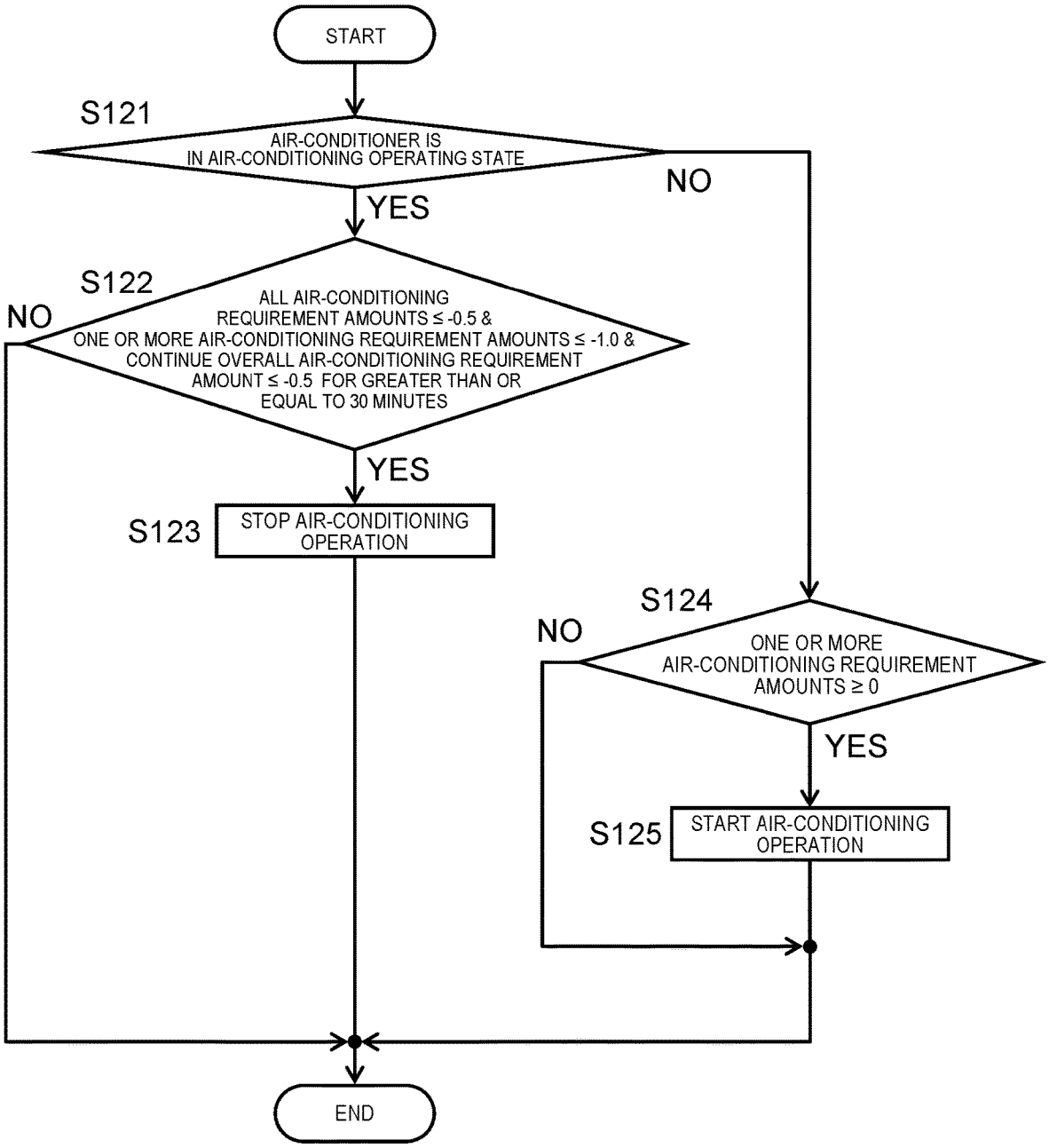
FIG. 14 is a flowchart showing a control behavior of operation start/stop of an air-conditioner of the controller in the air-conditioning system according to the second exemplary embodiment of the present disclosure.

Next, the behavior when controller 1030 performs the operation start/stop control of air-conditioner 1003 will be described with reference to FIG. 14. FIG. 14 is a flowchart showing the control behavior of operation start/stop of air-conditioner 1003 by controller 1030.

Figure 16:
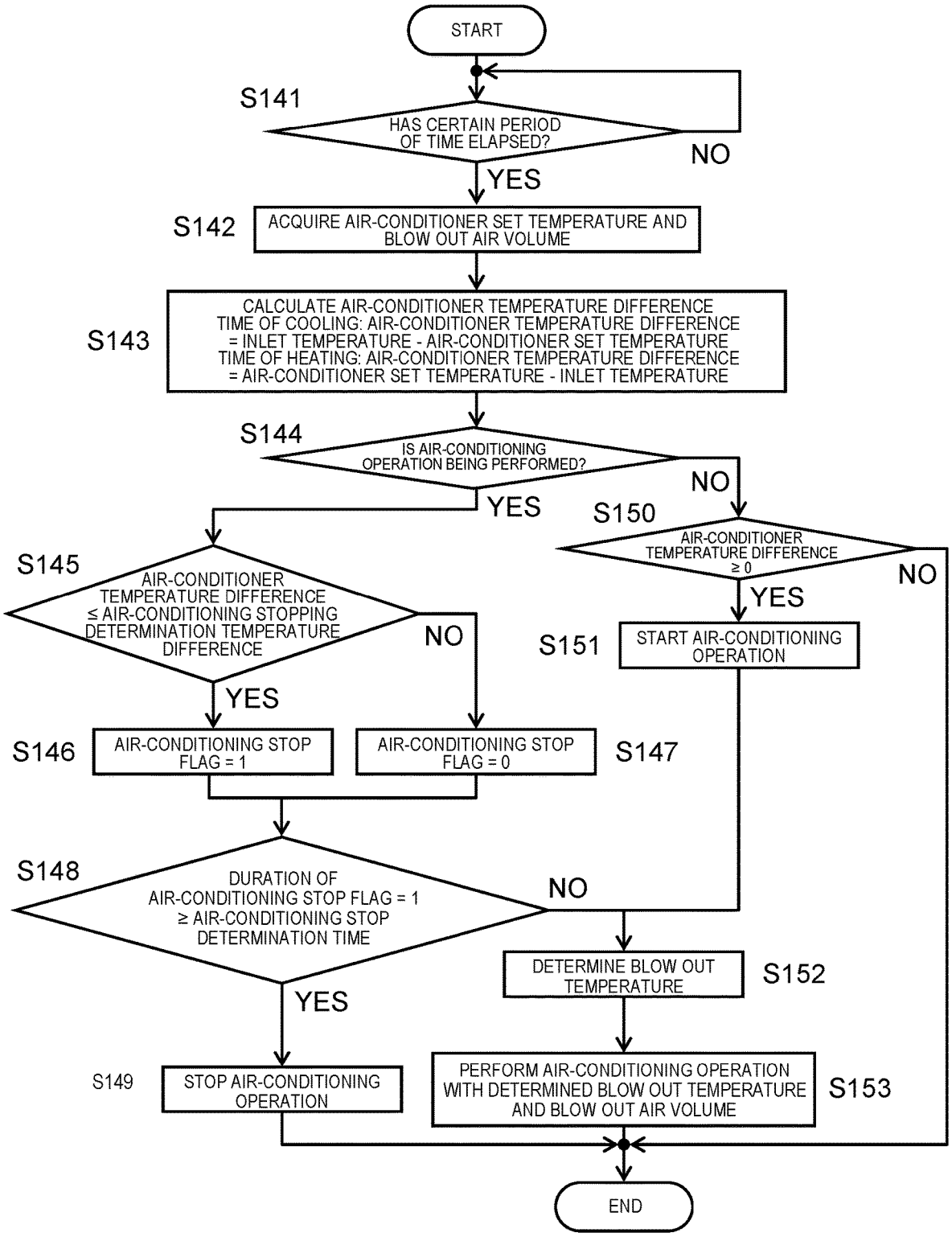
FIG. 16 is a flowchart showing an operation behavior of the air-conditioner in the air-conditioning system according to the second exemplary embodiment of the present disclosure.

In the present exemplary embodiment, air-conditioning system 1101 performs control of the operation/stop of air-conditioner 1003 only by an instruction from controller 1030 without using the air-conditioning operation/stop determination of air-conditioner 1003 itself illustrated in FIG. 16 described later. Doing so can prevent air-conditioner 1003 from unintentionally stopping and can perform stable control of air-conditioner 1003.

Controller 1030 performs control to stop the air-conditioning operation of air-conditioner 1003 when all of the following three stop conditions are satisfied.

<Stop Condition>

Condition 1: The air-conditioning requirement amounts of all air-conditioned spaces 1016 are less than or equal to −0.5° C.

Condition 2: The air-conditioning requirement amount of at least one of air-conditioned spaces 1016 is less than or equal to −1.0° C.

Condition 3: A state where the overall air-conditioning requirement amount is less than or equal to −0.5° C. continues for greater than or equal to 30 minutes.

Here, Condition 1 means that all air-conditioned spaces 1016 sufficiently satisfy the space set temperature set for air-conditioned space 1016. Condition 2 means that air-conditioning is performed at a temperature exceeding the space set temperature by greater than or equal to 1° C. in one or more air-conditioned spaces. Condition 3 means that air-conditioner 1003 is behaved at the possible lowest output that does not stop the air-conditioning.

Although details will be described later, when the overall air-conditioning requirement amount is less than or equal to −0.5° C., air-conditioner 1003 performs the air-conditioning operation at an air-conditioner temperature difference of about −0.5° C. In the present exemplary embodiment, in an operating state where the air-conditioner temperature difference is less than or equal to 0° C., air-conditioner 1003 performs the air-conditioning operation in a state where the air-conditioning output is minimum. At the time of the air-conditioning operation start, air-conditioner 1003 performs the air-conditioning operation with a slightly higher output than the minimum output. Therefore, unless Condition 3 exists, the air-conditioning operation is performed at a high output at the time of the air-conditioning operation start, whereby the temperature change of air-conditioned space 1016 increases, Condition 1 and Condition 2 are immediately satisfied, the air-conditioning operation is stopped, and the start/stop operation is performed. With Condition 3, the air-conditioning operation is continued for at least 30 minutes. Furthermore, when the outside air load allows the temperature of air-conditioned space 1016 to be kept constant by the air-conditioning operation at the minimum output, Condition 1 or Condition 2 is not satisfied, and therefore the air-conditioning operation can be continued.

Subsequently, the control behavior of the operation start/stop will be described in more detail with reference to the flowchart of FIG. 14. First, controller 1030 performs determination as to whether air-conditioner 1003 is currently performing the air-conditioning operation or stopping the air-conditioning operation (step S121). If air-conditioner 1003 is in the operating state (YES in step S121), it is determined whether or not the above-described three stop conditions (Condition 1 to Condition 3) are satisfied (step S122). As a result of the determination, if the three stop conditions are not satisfied (No in step S122), the air-conditioning operation of air-conditioner 1003 is continued, and the present control behavior is ended. On the other hand, if the three stop conditions are satisfied (YES in step S122), the air-conditioning operation of air-conditioner 1003 is stopped (step S123). Then, the present control behavior is ended.

On the other hand, if air-conditioner 1003 is in the stopped state (NO in step S121), it is determined whether or not an air-conditioning start condition is satisfied (step S124). More specifically, it is determined whether or not the air-conditioning requirement amount of at least one of air-conditioned spaces 1016 is greater than or equal to 0° C. As a result of the determination, if the air-conditioning start condition is satisfied (YES in step S124), the air-conditioning operation of air-conditioner 1003 is started (step S125), and the present control behavior is ended. On the other hand, if the air-conditioning start condition is not satisfied (NO in step S124), the stop state is continued, and the present control behavior is ended. Note that since the air-conditioning requirement amount indicates the degree of air-conditioning shortage, a positive value of the air-conditioning requirement amount means that air-conditioning is insufficient. That is, when at least one room has insufficient air-conditioning, controller 1030 starts the air-conditioning operation of air-conditioner 1003. By doing so, no room has insufficient air-conditioning, and therefore the operation can be continued without impairing comfort.

Figure 15:
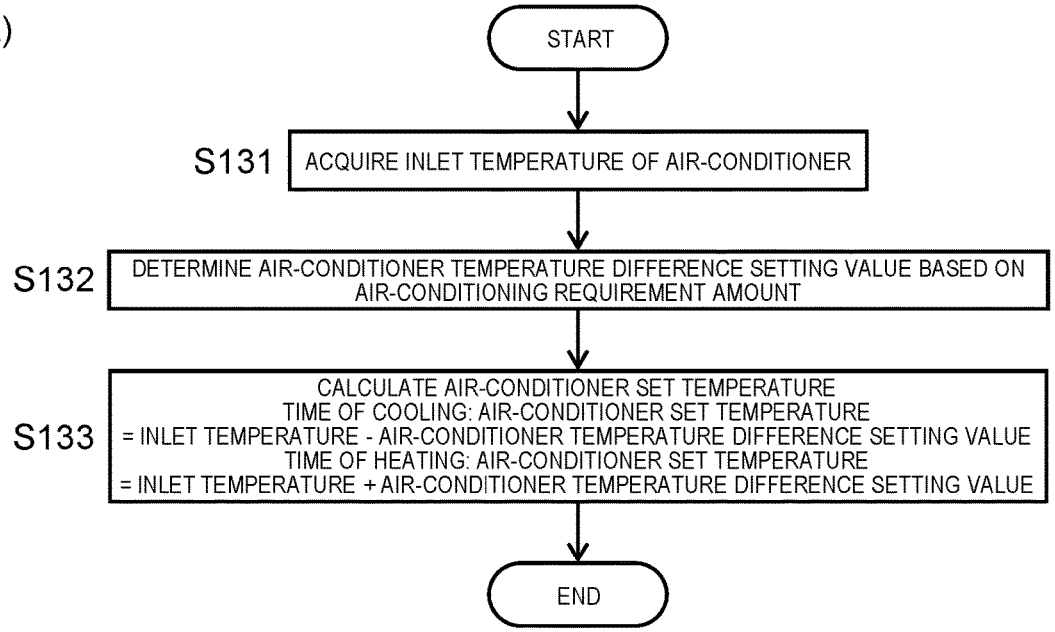
FIG. 15 is a flowchart showing a determination behavior of an air-conditioner set temperature of the controller in the air-conditioning system according to the second exemplary embodiment of the present disclosure.

Next, a specification method of the air-conditioner set temperature of controller 1030 will be described with reference to FIG. 15. FIG. 15 is a flowchart showing a determination behavior of the air-conditioner set temperature of controller 1030. (a) of FIG. 15 is a flowchart showing the determination behavior of the air-conditioner set temperature, and (b) of FIG. 15 is a determination table for determining the air-conditioner temperature difference setting value based on the air-conditioning requirement amount.

Since air-conditioning system 1101 includes the plurality of air-conditioned spaces 1016, the inlet temperature of air-conditioner 1003 and the temperature of each air-conditioned space 1016 do not necessarily coincide with each other. Therefore, the air-conditioner set temperature needs to be set different from the space set temperature set in air-conditioned space 1016.

First, controller 1030 acquires the inlet temperature of air-conditioner 1003 from inlet temperature sensor 1040 (step S131). Next, in accordance with the determination table illustrated in (b) of FIG. 15, the air-conditioner temperature difference setting value is determined from the overall air-conditioning requirement amount calculated in step S104 of FIG. 13 (step S132). At this time, a determination table in which the air-conditioner temperature difference setting value becomes a value larger than an air-conditioner stop determination temperature difference (−1.5° C. in the present exemplary embodiment) described later is used. Subsequently, the air-conditioner set temperature is determined with the inlet temperature and the air-conditioner temperature difference setting value (step S133). More specifically, a value in which the air-conditioner temperature difference setting value is added to the inlet temperature is the air-conditioner set temperature in a case of heating operation, and a value in which the air-conditioner temperature difference setting value is subtracted from the inlet temperature is the air-conditioner set temperature in a case of cooling operation. In the present exemplary embodiment, air-conditioner 1003 is assumed to be a general room air-conditioner, and therefore the air-conditioner set temperature is often a value in increments of 0.5° C. or 1.0° C. In this case, the value is rounded down or rounded off so that the value calculated from the inlet temperature and the air-conditioner temperature difference setting value becomes a value in increments of 0.5° C. or 1.0° C. In the present exemplary embodiment, the air-conditioner set temperature is determined in increments of 0.5° C.

Description will be made using specific numerals.

Assume a case where the inlet temperature is 20.7° C. and the overall air-conditioning requirement amount is 1.2° C. at the time of heating operation. The air-conditioner temperature difference setting value is 1.0° C. from the determination table. At this time, the air-conditioner set temperature is calculated as 20.7+1.0=21.7° C. Since the air-conditioner set temperature is in increments of 0.5° C., the calculated value is divided by 0.5, rounded off to the first decimal place, and then multiplied by 0.5 to be converted into a value in increments of 0.5. 21.7/0.5=43.4, which is rounded off to the first decimal place to be 43.0. 43.0×0.5=21.5, and the air-conditioner set temperature is determined to be 21.5° C. As described above, controller 1030 determines the air-conditioner set temperature. When the air-conditioner set temperature is converted in accordance with the increment width, in order to correspond to the difference between the air-conditioner set temperatures before and after the conversion, the air-conditioner temperature difference setting value in the determination table needs to be set to be larger than the air-conditioning stopping determination temperature difference by greater than or equal to the increment width. For example, when the increment width is 0.5° C., it is necessary to use a determination table in which the air-conditioner temperature difference setting value becomes larger than the air-conditioning stopping determination temperature difference +0.5° C. By doing so, even when the air-conditioner temperature difference setting value is different from a value of the air-conditioner temperature difference described later, the air-conditioner temperature difference no longer becomes less than or equal to the air-conditioning stopping determination temperature difference, and air-conditioner 1003 can be suppressed from stopping the air-conditioning operation.

Next, the operation behavior of air-conditioner 1003 will be described in detail with reference to FIG. 16. FIG. 16 is a flowchart showing the operation behavior of air-conditioner 1003.

In the present exemplary embodiment, air-conditioner 1003 is assumed to be a general room air-conditioner, and, based on a control signal from controller 1030, air-conditioner 1003 itself performs determination and control the air-conditioning behavior. Specifically, air-conditioner 1003 calculates a difference (hereinafter called "air-conditioner temperature difference") between the inlet temperature detected by inlet temperature sensor 1040 and the air-conditioner set temperature given from controller 1030, and performs control such that the larger the value of the air-conditioner temperature difference is, the lower the blow out temperature of air-conditioner 1003 is at the time of cooling operation and the higher the blow out temperature is at the time of heating operation. By doing this, when the air-conditioner temperature difference becomes large, the inlet temperature, that is, the temperature of the air-conditioning target space for air-conditioner 1003 gets close to the air-conditioner set temperature more quickly.

Air-conditioner 1003 performs start/stop determination of the air-conditioning operation based on the value of the air-conditioner temperature difference separately from the instruction of operation start/stop from controller 1030. This stops the air-conditioning when the air-conditioner temperature difference becomes small, and prevents the air-conditioning from becoming excessive.

First, air-conditioner 1003 performs determination of time lapse (step S141). As a result, if the certain period of time (e.g., 30 seconds) has not elapsed since the last processing (NO in step S141), air-conditioner 1003 returns to step S141. On the other hand, when the certain period of time has elapsed since the last processing (YES in step S141), the process proceeds to step S142, and start/stop determination of the air-conditioning operation and determination processing of blow out temperature and blow out air volume.

First, air-conditioner 1003 acquires the air-conditioner set temperature and the blow out air volume from controller 1030 (step S142). When the air-conditioner is used not in air-conditioning system 1101 but as a general room air-conditioner, the air-conditioner set temperature and the blow out air volume are acquired not from controller 1030 but by remote control input from the user or the like.

Next, air-conditioner 1003 calculates the air-conditioner temperature difference (step S143). More specifically, the air-conditioner temperature difference is specified based on a value in which the air-conditioner set temperature is subtracted from the inlet temperature at the time of cooling operation, and is specified based on a value in which the inlet temperature is subtracted from the air-conditioner set temperature at the time of heating operation. This means that the larger the air-conditioner temperature difference is at a positive value, the more air-conditioning is needed.

Next, air-conditioner 1003 performs determination as to whether or not the air-conditioning operation is being performed (step S144). As a result, if the air-conditioning operation is being performed (YES in step S144), the process proceeds to step S145 and a stop determination of the air-conditioning operation is performed. On the other hand, if the air-conditioning operation is stopped (NO in step S144), the process proceeds to step S150, and a start determination of the air-conditioning operation is performed.

In step S145, air-conditioner 1003 determines whether or not the air-conditioner temperature difference is larger than the air-conditioning stopping determination temperature difference. As a result, if the air-conditioner temperature difference is less than or equal to the air-conditioning stopping determination temperature difference (YES in step S145), an air-conditioning stop flag is "1" (step S146). If the air-conditioner temperature difference is larger than the air-conditioning stopping determination temperature difference (NO in step S145), the air-conditioning stop flag is "0" (step S147).

Next, air-conditioner 1003 performs the stop determination of the air-conditioning operation in step S148. If the time (duration) in which the air-conditioning stop flag is "1" has continued for longer than or equal to air-conditioning stop determination time (YES in step S148), air-conditioner 1003 stops the air-conditioning operation (step S149). On the other hand, if the air-conditioning stop flag=0 or the time in which the air-conditioning stop flag=1 is continued is shorter than the air-conditioning stop determination time (NO in step S148), air-conditioner 1003 continues the air-conditioning operation, proceeds to step S152, and performs determination of the blow out temperature (step S152). Note that in the present exemplary embodiment, the air-conditioner stop determination temperature difference is −1.5° C., and the air-conditioning stop determination time is 3 minutes.

The behavior of the air-conditioning stop determination will be described in detail with the time of heating operation as an example.

For example, when a state where the air-conditioner set temperature is 20° C. and the inlet temperature is 22° C. is continued for 3 minutes, the air-conditioner temperature difference is 20° C.−22° C.=−2° C., which is less than or equal to the air-conditioner stop determination temperature difference of −1.5° C., and therefore the air-conditioning stop flag is "1". Then, since the duration of the air-conditioning stop flag=1 becomes greater than or equal to the air-conditioning stop determination time of 3 minutes, air-conditioner 1003 stops the air-conditioning operation. In a case where the inlet temperature changes from 22° C. to 21° C. within 3 minutes at the time of heating operation, the air-conditioner temperature difference becomes 20° C.−21° C.=−1° C., which exceeds the air-conditioning stopping determination temperature difference, therefore, the air-conditioning stop flag becomes "0", and thus air-conditioner 1003 continues the air-conditioning operation. Also in a case where the inlet temperature does not change from 22° C. and the air-conditioner set temperature changes from 20° C. to 21° C. during 3 minutes of the heating operation, the air-conditioner temperature difference becomes 21° C.−22° C.=−1° C., which exceeds the air-conditioning stopping determination temperature difference, therefore, the air-conditioning stop flag is "0", and thus air-conditioner 1003 continues the air-conditioning operation.

If air-conditioner 1003 is in an operation stop state in step S144 (NO in step S144), air-conditioner 1003 performs a start determination of the air-conditioning operation (step S150). Specifically, whether or not the air-conditioner temperature difference is greater than or equal to 0 is determined. As a result of the determination, if the air-conditioner temperature difference is greater than or equal to 0 (YES in step S150), air-conditioner 1003 starts the air-conditioning operation (step S151), proceeds to step S152, and performs determination of the blow out temperature. On the other hand, if the air-conditioner temperature difference is less than 0 (NO in step S150), air-conditioner 1003 continues the air-conditioning stop state, and ends the present control behavior.

When air-conditioner 1003 is in the operating state, air-conditioner 1003 performs determination of the blow out temperature in step S152. The blow out temperature is determined such that the larger the value of the air-conditioner temperature difference is, the lower the blow out temperature of air-conditioner 1003 is at the time of cooling operation, and the higher the blow out temperature is at the time of heating operation. For example, when the air-conditioner set temperature is 23° C. and the inlet temperature is 22° C. at the time of heating operation, the air-conditioner temperature difference becomes 1° C. At this time, air-conditioner 1003 performs the air-conditioning behavior with the blow out temperature being 30° C. Subsequently, when the inlet temperature changes from 22° C. to 20° C., the air-conditioner temperature difference increases from 1° C. to 3° C., and air-conditioner 1003 increases the blow out temperature to 40° C. to perform air-conditioning.

Next, air-conditioner 1003 performs the air-conditioning operation, and blows air having the blow out temperature determined in step S152 with the blow out air volume acquired in step S142 (step S153).

Next, the behavior when air-conditioner 1003 is used in air-conditioning system 1101 will be described using a specific example.

By determining the air-conditioner temperature difference setting value as a value larger than the air-conditioner stop determination temperature difference (−1.5° C. in the present exemplary embodiment) in step S132 of FIG. 15, air-conditioner 1003 can be behaved so that the air-conditioner temperature difference becomes always larger than the air-conditioner stop determination temperature difference. That is, since the air-conditioner temperature difference always exceeds the air-conditioner stop determination temperature difference, the determination in step S145 in FIG. 16 always becomes NO determination (determination that the air-conditioner temperature difference is larger than the air-conditioning stopping determination temperature difference), and the air-conditioning stop flag is always "0". As a result, since the determination in step S148 also always becomes NO determination, the stop determination in step S149 is not started. When controller 1030 determines the air-conditioner set temperature, air-conditioner 1003 always behaves in order of step S145, step S147, step S148, step S152, and step S153. That is, air-conditioner 1003 does not start the air-conditioning stop determination and continues the air-conditioning operation at all times.

The time of heating operation will be specifically described as an example.

Assume that the space set temperature of air-conditioned space 1016 is 20° C. and the temperature of all air-conditioned spaces 1016 is 20.6° C. The air-conditioning requirement amount at this time is −0.6° C., and the air-conditioner temperature difference setting value becomes −0.5° C. according to the determination table illustrated in (b) of FIG. 15. Assume that the inlet temperature of air-conditioner 1003 at this time is 21.1° C., controller 1030 calculates the air-conditioner set temperature as 21.1° C.+(−0.5° C.)=20.6° C., converts it in increments of 0.5° C., and determines the air-conditioner set temperature as 20.5° C. Air-conditioner 1003 determines the air-conditioner temperature difference to be 20.5° C.−21.1° C.=−0.6° C. from the air-conditioner set temperature and the inlet temperature given by controller 1030. At this time, when the inlet temperature fluctuates from 21.1° C. to become 22.0° C., controller 1030 updates the air-conditioner set temperature according to step S133 to give 22.0° C.+(−0.5° C.)=21.5° C. Therefore, the air-conditioner temperature difference is 21.5° C.−22.0° C.=−0.5° C., and the temperature difference greater than or equal to the air-conditioning stopping determination temperature difference (−1.5° C.) is kept.

If the control in step S133 is not performed when the inlet temperature fluctuates from 21.0° C. to become 22.0° C., the air-conditioner set temperature remains at 20.5° C., the air-conditioner temperature difference is 20.5° C.−22.0° C.=−1.5° C. (=air-conditioning stopping determination temperature difference), and if this state continues for greater than or equal to the air-conditioning stop determination time (3 minutes), air-conditioner 1003 stops the air-conditioning operation.

Thus, in the conventional air-conditioning system that does not perform the control illustrated in FIG. 15, when the inlet temperature fluctuates, air-conditioner 1003 may stop, and air-conditioner 1003 behaves with a large power consumption such as repeating operation and stop. In air-conditioning system 1101 illustrated in the present exemplary embodiment, by performing the control illustrated in FIG. 15, it is possible to continuously operate air-conditioner 1003 even if the inlet temperature fluctuates, and it is possible to suppress deterioration of power consumption.

Figure 17:
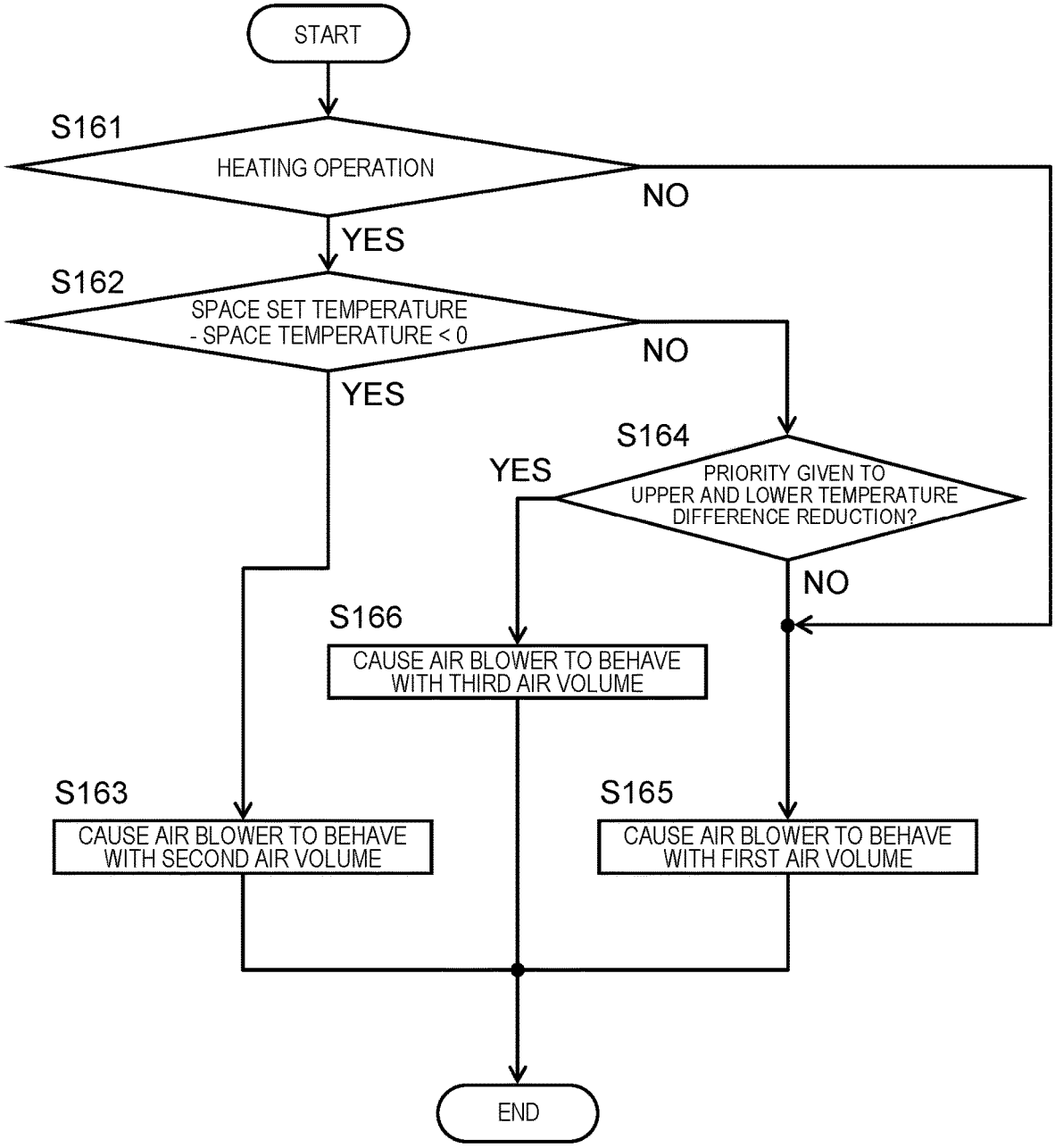
FIG. 17 is a flowchart showing a determination behavior of an upper and lower temperature difference reduction operation of the controller in the air-conditioning system according to the second exemplary embodiment of the present disclosure.

Next, the determination behavior of the upper and lower temperature difference reduction operation of controller 1030 will be described with reference to FIG. 17. FIG. 17 is a flowchart showing the determination behavior of the upper and lower temperature difference reduction operation of controller 1030.

First, controller 1030 determines whether or not air-conditioner 1003 is in the heating operation (step S161). As a result, if it is in the heating operation (YES in step S161), the process proceeds to step S162 to determine whether or not the upper and lower temperature difference reduction operation is possible. That is, controller 1030 determines whether to operate in the first control mode or to operate in the second control mode. If it is not in the heating operation (NO in step S161), the operation is performed in the first control mode, and is behaved at the first air volume equivalent to the blow out air volume of air-conditioner 1003 (step S165). Then, the present control behavior is ended.

In step S162, controller 1030 determines whether or not the temperature difference in which the space temperature is subtracted from the space set temperature, that is, the overall air-conditioning requirement amount calculated in step S104 is less than the reference temperature (e.g., 0° C.). As a result of the determination, if the overall air-conditioning requirement amount is less than the reference temperature (YES in step S162), the operation is performed in the second control mode, and air blower 1004 is caused to behave at the second air volume larger than the blow out air volume (first air volume) of air-conditioner 1003. Then, the present control behavior is ended. By doing this, the upper and lower temperature difference reduction operation is performed when the space temperature exceeds the space set temperature and the air-conditioning is sufficiently performed. In the present exemplary embodiment, the blow out air volume of air-conditioner 1003 is 500 $m^3$/h when the overall air-conditioning requirement amount is less than the reference temperature. At this time, the second air volume is determined to become larger than the blow out air volume from air-conditioner 1003 by 250 $m^3$/h. That is, the second air volume is 750 $m^3$/h.

If the overall air-conditioning requirement amount is greater than or equal to the reference temperature in step S162 (NO in step S162), the process proceeds to step S164. In step S164, whether or not to prioritize the upper and lower temperature difference reduction is determined based on input information from the user. That is, it is determined whether or not to preferentially execute the second control mode. When priority is given to the upper and lower temperature difference reduction (YES in step S164), the operation is performed in the second control mode, and air blower 1004 is behaved at the third air volume larger than the blow out air volume of air-conditioner 1003 and further larger than the second air volume (step S166). When priority is not given to the upper and lower temperature difference reduction (NO in step S164), the operation is performed in the first control mode, and air blower 1004 is behaved at the first air volume (step S165). Then, the present control behavior is ended. For example, when the overall air-conditioning requirement amount is 0.5° C., the blow out air volume of air-conditioner 1003 is 700 $m^3$/h, and at this time, when the operation is performed in the second control mode, the total air blow volume (third air volume) of air blower 1004 is 950 $m^3$/h. Since the blow out air volume of air-conditioner 1003 is increased to increase the air-conditioning output as the overall air-conditioning requirement amount increases, when the total air blow volume of air blower 1004 is further increased for the upper and lower temperature difference reduction in this state, there is a concern about generation of noise or an increase in power consumption. Therefore, the user is allowed to select whether to prioritize the upper and lower temperature difference reduction or to prioritize avoiding the generation of noise or the increase in power consumption. By doing so, it is possible to respond to various needs of the user.

Figure 18:
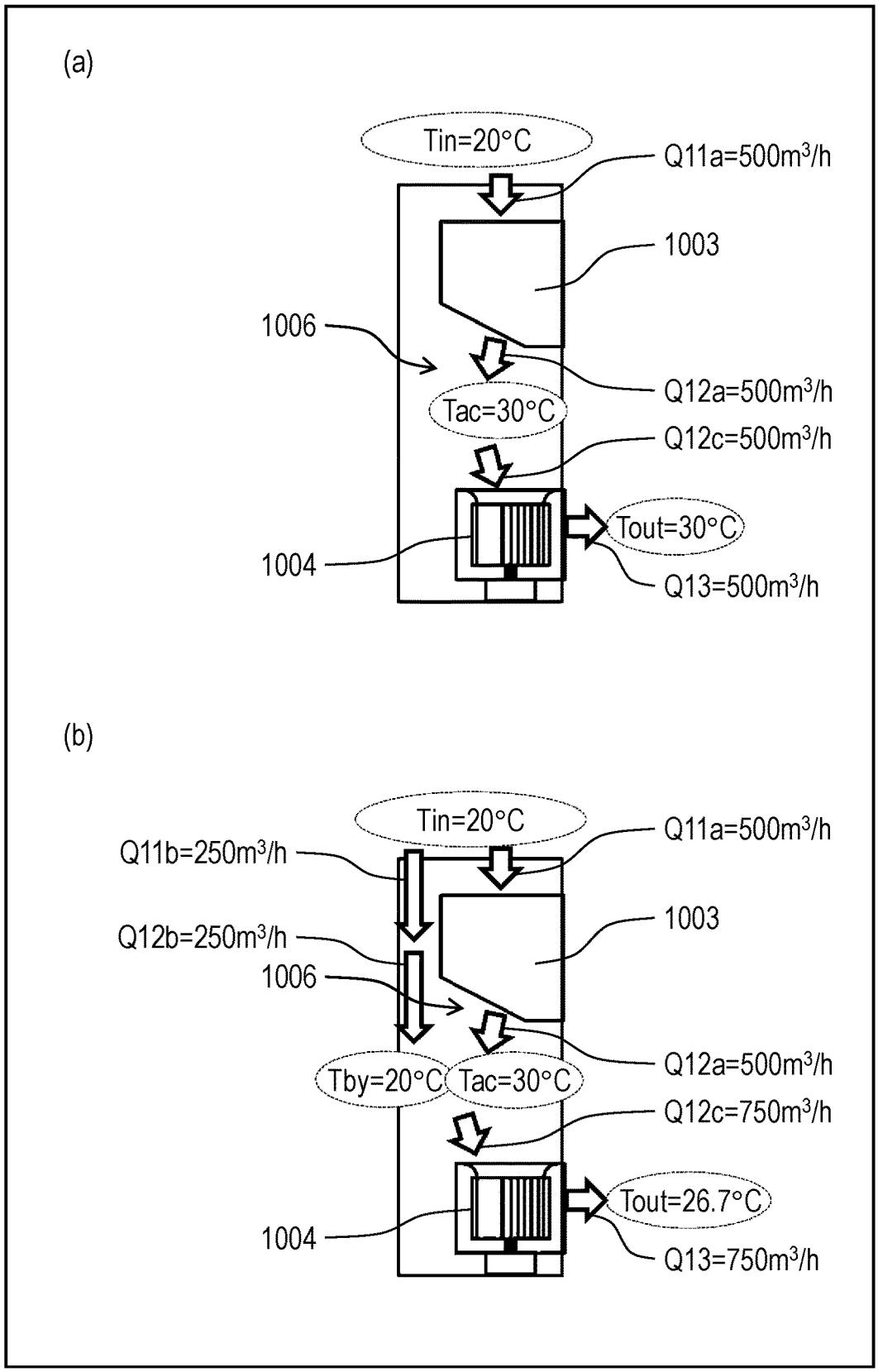
FIG. 18 is a schematic diagram illustrating a temperature distribution in the air-conditioning unit in the air-conditioning system according to the second exemplary embodiment of the present disclosure.

Next, a temperature change of air Q13 sent out to air-conditioned space 1016 when the upper and lower temperature difference reduction operation is performed in the second control mode will be described with reference to FIG. 18. FIG. 18 is a schematic diagram illustrating a temperature distribution in air-conditioning unit 1001. (a) of FIG. 18 is a schematic diagram illustrating a temperature distribution in air-conditioning unit 1001 when operated in the first control mode. (b) of FIG. 18 is a schematic diagram illustrating a temperature distribution in air-conditioning unit 1001 when operated in the second control mode.

Assume that the temperature of air Q11 suctioned by air-conditioning unit 1001 is temperature Tin, the temperature of air Q12*a* blown out by air-conditioner 1003 is temperature Tac, the temperature of air Q12*b* bypassing air-conditioner 1003 and flowing into air-conditioner installation space 1006 is temperature Tby, and the temperature of air Q13 sent out from air blower 1004 is temperature Tout.

The temperature distribution of air-conditioning unit 1001 when operated in the first control mode will be described with reference to (a) of FIG. 18. First, the flow of air at the time of the first control mode will be described.

In the first control mode, the total air blow volume of air blower 1004 is made equal to the blow out air volume (first air volume) of air-conditioner 1003. Therefore, in the example of (a) of FIG. 18, when the air volume of air Q11*a* suctioned by air-conditioner 1003 is 500 $m^3$/h, air Q11*a* suctioned by air-conditioner 1003, air Q12*a* blown out by air-conditioner 1003, air Q12*c* suctioned by air blower 1004, and air Q13 sent out by air blower 1004 all have the same air volume of 500 $m^3$/h. When temperature Tin of air Q11*a* is 20° C., the temperature of air Q11*a* is raised by air-conditioner 1003, and temperature Tac of air Q12*a* blown out from air-conditioner 1003 becomes, for example, 30° C. In the first control mode, air Q12*a* blown out from air-conditioner 1003 is suctioned into air blower 1004 as air Q12*c* as it is and sent out as air Q13. Therefore, temperature Tout of air Q13 becomes 30° C.

Next, the temperature distribution of air-conditioning unit 1001 when operated in the second control mode will be described with reference to (b) of FIG. 18. First, the flow of air at the time of the second control mode will be described.

In the second control mode, the total air blow volume of air blower 1004 is determined to become larger than the blow out air volume (first air volume) of air-conditioner 1003. Specifically, the total air blow volume of air blower 1004 is the second air volume larger than the first air volume. Therefore, air Q11 suctioned by air-conditioning unit 1001 is divided into air Q11*a* circulating through air-conditioner 1003 and air Q11*b* bypassing air-conditioner 1003. The temperature of air Q11*a* is raised by air-conditioner 1003, and blown out from air-conditioner 1003 as air Q12*a*. Air Q11*b* flows into air-conditioner installation space 1006 as air Q12*b* while maintaining the same temperature. Air Q12*a* and air Q12*b* are mixed, suctioned into air blower 1004 as air Q12*c*, and sent out from air blower 1004 as air Q13. For example, assume that temperature Tin of air Q11 is 20° C., the blow out air volume of air-conditioner 1003 (air volume of air Q11*a* and air Q12*a*) is 500 $m^3$/h, and the total air blow volume of air blower 1004 (air volume of air Q12*c* and air Q13) is 750 $m^3$/h. At this time, the air volume of air Q11*b* and air Q12*b* is calculated by the difference between the total air blow volume of air blower 1004 and the blow out air volume of air-conditioner 1003, and becomes 750 $m^3$/h−500 $m^3$/h=250 $m^3$/h.

Assume that as a result of temperature rise of air Q11*a* having temperature Tin of 20° C. by air-conditioner 1003, temperature Tac of air Q12*a* becomes 30° C., temperature Tby of air Q12*b* is 20° C., which is the same as the temperature of air Q11*a*. The temperature of air Q12*c* after mixing is obtained by a weighted mean in which the temperature of the air before mixing is weighted with the air volume, and becomes (20° C.×250 $m^3$/h+30° C.×500 $m^3$/h)/(250 $m^3$/h+500 $m^3$/h)~26.7° C. Therefore, temperature Tout of air Q13 sent out from air blower 1004 becomes 26.7° C., which is a lower temperature than temperature Tout (30° C.) when operated in the first control mode in (a) of FIG. 18. After being sent out from air blower 1004, air Q13 is blown out from air supply port 1015 to air-conditioned space 1016. As described later, air having a lower temperature is blown out from air supply port 1015.

In this manner, the temperature of air Q13 blown out from air supply port 1015 can be lowered by increasing the total air blow volume of air blower 1004 without changing the blow out temperature and the blow out air volume of air-conditioner 1003. That is, since the output of air-conditioner 1003 does not change, it is possible to blow out air Q13 whose temperature has been lowered without causing insufficient air-conditioning or excessive air-conditioning.

Figure 19:
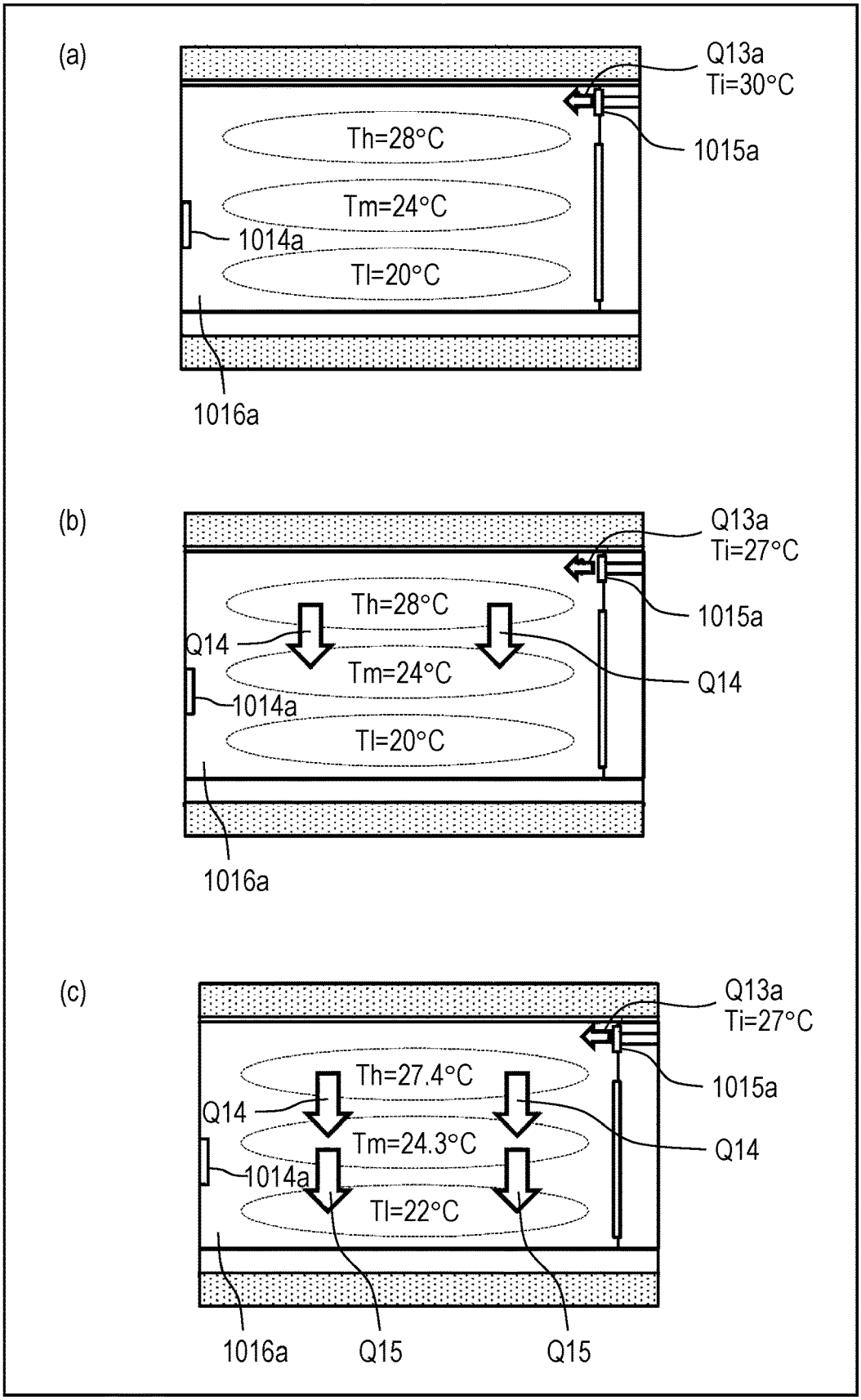
FIG. 19 is a schematic diagram illustrating a temperature distribution of an air-conditioned space at the time of the upper and lower temperature difference reduction operation in the air-conditioning system according to the second exemplary embodiment of the present disclosure.

Next, a scene where the upper and lower temperature difference of the air in air-conditioned space 1016 is reduced when operated in the second control mode will be described using air-conditioned space 1016*a* as an example with reference to FIG. 19. FIG. 19 is a schematic diagram illustrating the temperature distribution in air-conditioned space 1016*a* during the upper and lower temperature difference reduction operation. (a) of FIG. 19 is a schematic diagram illustrating an example of the temperature distribution when the space temperature of air-conditioned space 1016*a* is recognized to have reached the space set temperature. (b) of FIG. 19 is a schematic diagram illustrating an example of the temperature distribution immediately after the operation is started in the second control mode. (c) of FIG. 19 is a schematic diagram illustrating an example of the temperature distribution in a state where the operation is performed in the second control mode and the upper and lower temperature difference is reduced.

Assume that the temperature of the air in the upper part of the room in the vicinity of the ceiling in air-conditioned space 1016*a* is temperature Th, the temperature of the air near the center of the space including the height at which space temperature sensor 1014*a* is installed is temperature Tm, the temperature of the air in the lower part of the space in the vicinity of the floor is temperature Tl, and the temperature of the air discharged from air supply port 1015*a* is discharge temperature Ti. Here, when a heat load from the outside such as cold air is applied, discharge temperature Ti from air supply port 1015*a* needs to be greater than or equal to the space set temperature in order to maintain or increase the space temperature by the heating operation. If the space temperature is to be brought closer to the space set temperature more quickly, the discharge temperature needs to be made higher.

For example, assume that the heating operation is performed in the first control mode with the set temperature of air-conditioned space 1016*a* being 24° C. (a) of FIG. 19 illustrates an example of the temperature distribution when the space temperature of air-conditioned space 1016*a* is recognized to have reached the space set temperature, and temperature Tm of the air near the center of the space including the height at which space temperature sensor 1014*a* is installed is 24° C. At this time, discharge temperature Ti from air supply port 1015*a* is higher than the temperature of the air near the center of the space, for example, 30° C. Therefore, air having temperature Th (28° C.) close to the temperature of the discharge air stays in the vicinity of the ceiling, and the upper and lower temperature difference is generated in air-conditioned space 1016*a*.

After FIG. 19(*a*), when the operation in the second control mode is started, discharge temperature Ti from air supply port 1015*a* decreases to, for example, 27° C.

At this time, as illustrated in (b) of FIG. 19, since discharge temperature Ti from air supply port 1015*a* is lower than temperature Th of the air in the vicinity of the ceiling, discharge temperature Ti is higher in density than the air in the vicinity of the ceiling, and decreases downward while exchanging heat with the surrounding air. That is, the flow of air Q14 (downward airflow by air Q14) directed downward from the vicinity of the ceiling is generated. By being heat exchanged with the air having a low temperature, temperature Th of the air in the vicinity of the ceiling gradually decreases. At the same time, temperature Tm of the air near the center of the space gradually rises due to the downward airflow by air Q14. As illustrated in (c) of FIG. 19, the downward airflow by air Q14 forms a flow of air Q15 (downward airflow by air Q15) directed further downward from near the center of the space in accordance with the strength of the flow, or forms a downward airflow by air Q15 when the temperature of air Q14 is lower than the temperature near the center of the space. Due to this, the high-temperature air in the upper part of the space flows into the lower part of the space by the downward airflow due to air Q15, and temperature Tl of the air in the lower part of the space rises. As a result, the upper and lower temperature difference in air-conditioned space 1016*a* can be reduced.

As described above, air-conditioning system 1101 according to the present second exemplary embodiment can achieve the following effects.

(1) Air-conditioning system 1101 includes air-conditioning unit 1001 that supplies air-conditioned air to the plurality of air-conditioned spaces 1016, unit body 1002 that forms an outline of air-conditioning unit 1001, air-conditioner 1003 that performs temperature control of air Q11 taken into unit body 1002, air blower 1004 that blows, to the outside of unit body 1002, air Q12 blown out from air-conditioner 1003, air supply port 1015 that is installed on an inner wall surface of air-conditioned space 1016 and discharges air Q13 blown by air blower 1004, and controller 1030 that controls air-conditioner 1003. Air supply port 1015 discharges air Q13 in the horizontal direction with respect to the floor surface of air-conditioned space 1016 in the vicinity of the ceiling of air-conditioned space 1016. Then, in the heating operation of air-conditioner 1003, controller 1030 causes air-conditioner 1003 to behave at the first air volume, causes air blower 1004 to behave at a similar air volume to the first air volume when the temperature difference in which the temperature of air-conditioned space 1016 is subtracted from a space set temperature is greater than or equal to a reference temperature, and causes air blower 1004 to behave at a second air volume larger than the first air volume when the temperature difference is less than the reference temperature.

According to such configuration, when the temperature difference in which the temperature of air-conditioned space 1016 is subtracted from the space set temperature becomes less than the reference temperature, the air volume of air blower 1004 becomes larger than the air volume of air-conditioner 1003 from the first air volume to the second air volume, whereby air Q12*a* air-conditioned by air-conditioner 1003 and the air outside air-conditioning unit 1001 (air Q12*b* not air-conditioned by air-conditioner 1003) are mixed and blown from air blower 1004. Therefore, in addition to the increase in the air volume of air Q13 discharged from air supply port 1015 of air-conditioned space 1016, the temperature of air Q13 discharged from air supply port 1015 of air-conditioned space 1016 decreases, and the buoyancy is reduced, therefore, an airflow (downward airflow by air Q14 and air Q15) flowing from the upper part to the lower part of air-conditioned space 1016 is easily formed, and the upper and lower temperature difference of air-conditioned space 1016 is reduced.

(2) In air-conditioning system 1101, when the temperature difference is greater than or equal to the reference temperature, controller 1030 is switchable between the first control mode in which air blower 1004 is behaved with a similar same air volume to the first air volume and the second control mode in which air blower 1004 is behaved with the third air volume larger than the second air volume. Due to this, when the temperature difference is large, the blow out temperature of air-conditioner 1003 also increases, but by further increasing the air volume of air blower 1004 from the first air volume to the third air volume, the temperature of air Q13 blown out from air supply port 1015 of air-conditioned space 1016 decreases, and therefore the effect of the upper and lower temperature difference reduction can be obtained even when the temperature difference is large.

(3) In air-conditioning system 1101, when switching the air volume of air blower 1004 from the first air volume to the second air volume, controller 1030 holds the temperature of the air temperature-controlled by air-conditioner 1003 at a predetermined temperature. Due to this, since the output of air-conditioner 1003 does not change, it is possible to avoid insufficient air-conditioning or excessive air-conditioning, and it is possible to reduce the upper and lower temperature difference of air-conditioned space 1016 while keeping air-conditioned space 1016 at a comfortable temperature.

(4) In air-conditioning system 1101, air supply port 1015 can blow air only in the horizontal direction with respect to the floor surface of air-conditioned space 1016 without including a louver. This enables temperature control of air-conditioned space 1016 with air-conditioning system 1101 that is simpler, and enables cost reduction.

The present disclosure has been described in the foregoing based on the exemplary embodiment. It is understood by those skilled in the art that the exemplary embodiments are merely examples, that the components or the treatment processes can be combined as various modifications, and that such modifications also fall within the scope of the present disclosure.

INDUSTRIAL APPLICABILITY

An air-conditioning system according to the present disclosure is useful as a system that can suppress start/stop operation of an air-conditioner installed in an air-conditioning unit and improve energy saving performance, and enables air-conditioning of a plurality of rooms of a house with one air-conditioner.

REFERENCE MARKS IN THE DRAWINGS

1: air-conditioning unit
2: unit body
3: air-conditioner
4, 4*a*, 4*b*: air blower
5: inlet
6: air-conditioner installation space
7: air blower installation space
8, 8*a*, 8*b*: outlet
9: filter
11, 11*a*, 11*b*: duct
12, 12*a*, 12*b*: branch chamber
13, 13*a*, 13*b*, 13*c*, 13*d*: damper
14, 14*a*, 14*b*, 14*c*, 14*d*: indoor temperature sensor
15, 15*a*, 15*b*, 15*c*, 15*d*: air supply port
16, 16*a*, 16*b*, 16*c*, 16*d*: air-conditioned space
17, 17*a*, 17*b*: common space
18: attic
19: space above ceiling
20: dedicated installation space
30: controller
30*a*: operation panel
30*b*: inputter
30*c*: processing unit
30*d*: storage
30*e*: timer
30*g*: air volume determiner
30*h*: set temperature determiner
30*i*: outputter
30*j*: display panel
40: inlet temperature sensor
100: house
101: air-conditioning system
Q1, Q2, Q3, Q1*a*, Q1*b*, Q2*a*, Q2*b*, Q3*a*, Q3*b*: air
1001: air-conditioning unit
1002: unit body
1003: air-conditioner
1004, 1004*a*, 1004*b*: air blower
1005: inlet
1006: air-conditioner installation space
1007: air blower installation space
1008, 1008*a*, 1008*b*: outlet
1009: filter
1011, 1011*a*, 1011*b*: duct
1012, 1012*a*, 1012*b*: branch chamber
1014, 1014*a*, 1014*b*, 1014*c*, 1014*d*: space temperature sensor
1015, 1015*a*, 1015*b*, 1015*c*, 1015*d*: air supply port
1016, 1016*a*, 1016*b*, 1016*c*, 1016*d*: air-conditioned space
1017, 1017*a*, 1017*b*: common space
1018: attic
1019: space above ceiling
1020: dedicated installation space
1030: controller
1030*a*: operation panel
1030*b*: inputter
1030*c*: processing unit

1030*d*: storage
1030*e*: timer
1030*g*: air volume determiner
1030*h*: set temperature determiner
1030*i*: outputter
1030*j*: display panel
1040: inlet temperature sensor
1100: house
1101: air-conditioning system
Q11, Q12, Q13, Q14, Q15, Q16, Q17, Q11*a*, Q11*b*, Q12*a*, Q12*b*, Q12*c*, Q13*a*, Q13*b*: air

The invention claimed is:

1. An air-conditioning system comprising:

an air-conditioning unit that supplies air-conditioned air to a plurality of spaces;

a unit body that forms an outline of the air-conditioning unit;

an air-conditioner that performs temperature control of air taken into the unit body;

one or more air blowers that blow, to an outside of the unit body, air having been blown out from the air-conditioner; and a controller that controls the air-conditioner, wherein the controller (i) determines an air-conditioner set temperature to cause an air-conditioner temperature difference, which is a temperature difference between an inlet temperature, which is a temperature of air suctioned by the air-conditioner, and the air-conditioner set temperature set to the air-conditioner, to have a larger value than an air-conditioning stopping determination temperature difference that defines a temperature difference at which an air-conditioning operation is stopped, and (ii) causes the air-conditioner to perform an air-conditioning operation with the air-conditioner set temperature having been determined, and wherein the controller (i) determines an air-conditioning requirement amount for each of the plurality of spaces based on a temperature difference between a temperature of the space and an indoor set temperature set for the space, and (ii) causes the air-conditioner to stop the air-conditioning operation when all of a first condition in which the air-conditioning requirement amount having been determined becomes less than or equal to a first reference temperature in all of the spaces, a second condition in which the air-conditioning requirement amount having been determined becomes less than or equal to a second reference temperature in at least one of the spaces, and a third condition in which an air-conditioning operating time of the air-conditioner becomes greater than or equal to a predetermined time in a state where a mean value of the air-conditioning requirement amounts having been determined becomes less than or equal to a third reference temperature are satisfied.

2. The air-conditioning system according to claim 1, wherein the controller causes the air-conditioner to start the air-conditioning operation in a case where the air-conditioning requirement amount becomes larger than a fourth reference temperature in at least one of the spaces while the air-conditioner is stopping air-conditioning operation.

* * * * *